US006386686B1

(12) United States Patent
Kubota et al.

(10) Patent No.: US 6,386,686 B1
(45) Date of Patent: May 14, 2002

(54) LIQUID DISCHARGE HEAD, MANUFACTURING METHOD OF LIQUID DISCHARGE HEAD, HEAD CARTRIDGE, AND LIQUID DISCHARGE APPARATUS

(75) Inventors: Masahiko Kubota, Tokyo; Aya Yoshihira, Yokohama; Kiyomitsu Kudo, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/448,597

(22) Filed: Nov. 24, 1999

(30) Foreign Application Priority Data

Dec. 3, 1998 (JP) ..... 10-344752
Dec. 3, 1998 (JP) ..... 10-344753

(51) Int. Cl.[7] ..... B41J 2/05
(52) U.S. Cl. ..... 347/63; 347/65
(58) Field of Search ..... 347/20, 54, 56, 347/63, 65, 67

(56) References Cited

U.S. PATENT DOCUMENTS

| | | | | |
|---|---|---|---|---|
| 3,379,803 A | 4/1968 | Tittmann et al. | ..... | 264/81 |
| 4,480,259 A | 10/1984 | Kruger et al. | ..... | 347/63 |
| 4,723,129 A | 2/1988 | Endo et al. | ..... | 347/56 |
| 5,943,074 A | 8/1999 | Kashino et al. | ..... | 347/54 |
| 6,007,187 A | 12/1999 | Kashino et al. | ..... | 347/65 |

FOREIGN PATENT DOCUMENTS

| | | | | |
|---|---|---|---|---|
| EP | 841166 | 5/1998 | ..... | B41J/2/14 |
| EP | 920997 | * 6/1999 | ..... | B41J/2/05 |
| JP | 44-21353 | 8/1969 | | |
| JP | 52-37479 | 9/1977 | ..... | C23C/13/04 |
| JP | 61-59911 | 5/1979 | ..... | B41J/3/04 |
| JP | 61-59914 | 2/1980 | ..... | B41J/3/04 |
| JP | 55-81172 | 6/1980 | ..... | B41J/3/04 |
| JP | 59-26270 | 2/1984 | ..... | B41J/3/04 |
| JP | 4-329148 | 11/1992 | ..... | B41J/2/05 |
| JP | 5-229122 | 9/1993 | ..... | B41J/2/05 |

OTHER PUBLICATIONS

Patent Abstracts of Japan, vol. 013, No. 588 (M–912), Dec. 25, 1989, regarding JP 1–247168A.

* cited by examiner

*Primary Examiner*—John Barlow
*Assistant Examiner*—Juanita Stephen
(74) *Attorney, Agent, or Firm*—Fitzpatrick, Cella, Harper & Scinto

(57) ABSTRACT

A liquid discharge head has a plurality of first liquid flow passages connected to outlets for discharging the discharge liquid, a plurality of second liquid flow passages having an element board with heating elements for generating a bubble in the bubbling liquid and corresponding to the first liquid flow passages, and movable separation films substantially and mutually separating the first liquid flow passages and the second liquid flow passages at all times, wherein the movable separation films are mutually independent individual separation films for each of the second liquid flow passages. It is possible to directly provide a flow passage wall configuring a side wall of a first liquid flow passage onto the element board by the low temperature junction by using surface activation since the movable separation films are individual separation films. The junction of the flow passage wall to the element board is surely performed and the dispersion in discharge characteristics depending on the lot of products can be restrained.

29 Claims, 21 Drawing Sheets

LIQUID DISCHARGE HEAD, MANUFACTURING METHOD OF LIQUID DISCHARGE HEAD, HEAD CARTRIDGE, AND LIQUID DISCHARGE APPARATUS

BACKGROUND OF THE INVENTION

1. Field of the Invention

The present invention relates to a manufacturing method of a liquid discharge head which discharges a desired liquid by using the production of bubbles caused by making thermal energy act on the liquid, a liquid discharge head, a head cartridge using the liquid discharge head, and a liquid discharge device.

Furthermore, the present invention is an invention which can be applied to a device such as a printer, a copying machine, a facsimile with a communication system, or a word processor with a printer portion, and further, an industrial recording apparatus compositely combined with various kinds of processors, which performs recording to a record medium such as paper, thread, fiber, fabric, leather, metal, plastic, glass, wood, ceramics.

By the way, "record" in the present invention means not only to give a meaningful image such as a character or a figure to a record medium but also to give a meaningless image such as a pattern.

2. Related Background Art

The ink jet recording method, the so-called bubble jet recording method has previously been known, in which a change of state accompanying a rapid change of volume (generation of bubbles) is caused in ink by giving energy of heat or the like to the ink, and the ink is discharged from an outlet by the acting force based on this change of state, and this is adhered onto a record medium, so that an image formation may be performed. A recording apparatus using this bubble jet recording method generally has an outlet for discharging ink, an ink flow passage connected to this outlet, and a heating element (electrothermal energy converting substance) which is arranged in the ink flow passage as an energy generating means for discharging the ink, as disclosed in Japanese Patent Publication No. 61-59911 and Japanese Patent Publication No. 61-59914.

By using the above recording method, an image with a high quality image can be recorded at a high speed and at a low noise level, and in the meantime, since outlets for discharging ink can be arranged with a high density, a head performing this recording method has a lot of advantages such as the advantage that a record image with a high resolution can easily be obtained, and further, a color image can also easily be obtained by a small sized device. Therefore, recently, this bubble jet recording method has been used in a lot of office machines such as a printer, a copying machine, or a facsimile, and further, it is also used in an industrial system such as a printing device.

On the other hand, in a conventional bubble jet recording method, the heating is repeated in the state where the heating element is in contact with ink, and therefore, there have been some cases where deposits caused by the scorching of ink is produced on the surface of the heating element. Furthermore, in the case where the liquid to be discharged is a liquid which may easily be degraded by heat, or in the case where the liquid to be discharged is a liquid in which it is difficult to sufficiently obtain the bubbling, there are some cases where a preferable discharge cannot be performed by the direct heating bubble formation using the above heating element.

In contrast with this, the applicant of the present application has proposed a method in which the bubbling liquid is bubbled by thermal energy to discharge the discharge liquid, through a flexible film separating the bubbling liquid and the discharge liquid in Japanese Patent Application Laid-Open No. 55-81172. The configuration of the flexible film and the bubbling liquid in this method is a constitution in which the flexible film is provided at a part of a nozzle, but in contrast with that, a constitution using a large film for separating the total of a head into an upper part and a lower part is disclosed in Japanese Patent Application Laid-Open No. 59-26270. This large film is provided with a purpose of preventing the liquids in 2 liquid flow passages from being mutually mixed, by being held between 2 sheet members forming the liquid flow passage.

On the other hand, as a constitution in which the bubbling liquid itself has characteristics and bubbling characteristics are considered, there is a constitution which is disclosed in Japanese Patent Application Laid-Open No. 5-229122 and uses a liquid with a boiling point lower than that of the discharge liquid, or a constitution which is disclosed in Japanese Patent Application Laid-Open No. 4-329148 and uses a conductive liquid as bubbling liquid.

However, when the present inventor and others examined to actually manufacture a liquid discharge head using such a separation film, the following problems were found.

That is, since the separation film is positioned between a base board having a plurality of heating elements and a top board for forming a common liquid chamber, there is an anxiety that a mounting device of the film is complicated or that the film is damaged when mounting the film, in the case of independently handling a deformable separation film.

Furthermore, it is difficult to adhere the film at desired positions of the ink flow passage provided in a head and the heater, and to surely fix the area other than the movable portion of the film, and it is considered that the dispersion in discharge performance depending on products may increase. Furthermore, since the liquid discharge caused by the bubble formation by the thermal energy is performed through the displacement of the separation film, there is an anxiety that the discharge efficiency may be lowered at that rate. Accordingly, in case of using the structure of a film applied for a patent by the present inventor and others for attaining a liquid discharge with a higher level while keeping the effect created by the separating function of a separation film, it is necessary to solve this problem by a simple method.

Furthermore, from another view point, the present inventor and others have found a new technological problem which has not existed previously, in the case of performing a liquid discharge based on the bubble formation caused by film boiling using an organic film and using a heating element. That is, it is a technological problem found by considering the thermal factor in the displacement of a separation film accompanied with a series of changes of generation of bubbles—growth—deforming, or by considering the practically probable situation of improving the durability for a separation film simple substance or an ink jet head.

SUMMARY OF THE INVENTION

It is a first object of the present invention to provide a liquid discharge head which solves the above problems, and which has a small dispersion in discharge performance depending on products and has a high reliability, and which can record a highly detailed image.

It is a second object of the present invention to provide a liquid discharge head which solves the above problems, and which further improves the discharge efficiency of liquid by a simple constitution while keeping the effect based on the separating function of a separation film.

It is a third object of the present invention to provide a manufacturing method of a liquid discharge head which solves the above problems, and which has a small dispersion in discharge performance depending on products and has a high reliability.

It is a fourth object of the present invention to provide a manufacturing method of a liquid discharge head in which a damage of a movable film in the manufacturing step or the like is prevented by eliminating the step of independently handling a movable film.

It is a residual object of the present invention to provide various related inventions to be described later of a manufacturing method of a liquid discharge head, a liquid discharge head, a head cartridge, a liquid discharge device or the like which have been created by the present inventor and others in the course of solving the above problems.

A liquid discharge head of the present invention for solving the above problems is a liquid discharge head comprising: a plurality of first liquid flow passages which are connected to outlets for discharging discharge liquid; a plurality of second liquid flow passages which have an element board with heating elements for generating bubbles in bubbling liquid and which correspond to the above first liquid flow passages; and movable separation films which substantially and mutually separate the above first liquid flow passages and the above second liquid flow passages corresponding thereto at all times, wherein the above movable separation films are mutually independent individual separation films for the above respective second liquid flow passages.

According to the above liquid discharge head, it is possible to directly provide a flow passage wall configuring a side wall of a first liquid flow passage on the element board by the low temperature (normal temperature) junction by using surface activation since the movable separation films are individual separation films. Consequently, the junction of the flow passage wall to the element board is surely performed and the dispersion in discharge characteristics depending on the lot of products or the like can be restrained as a result.

Furthermore, a liquid discharge head of the present invention is a liquid discharge head comprising: a first liquid flow passage connected to an outlet for discharging discharge liquid; a second liquid flow passage which has an element board with a heating element for generating bubbles in bubbling liquid and which corresponds to the above first liquid flow passage; and a movable separation film which substantially and mutually separates the above first liquid flow passage and the above corresponding second liquid flow passage at all times, wherein the liquid discharge head further comprises a seat to which the above movable separation film is physically or chemically joined, and the above movable separation film is not physically and chemically joined to the end portion on the above heating element side of the above seat.

According to the above liquid discharge head, since the movable separation film is joined to the seat but it is not joined to the end portion on the heating element side of this seat, it is possible to enlarge the movable area of the movable separation film. Consequently, the amount of displacement of the movable separation film based on the generation of bubbles in the second liquid flow passage is increased, and the discharge efficiency of the discharge liquid is improved.

Furthermore, a liquid discharge head of the present invention is a liquid discharge head comprising: a plurality of first liquid flow passages connected to outlets for discharging discharge liquid; a plurality of second liquid flow passages which have an element board with heating elements for generating bubbles in bubbling liquid and which correspond to the above first liquid flow passages; and a movable separation organic film which substantially and mutually separates the above first liquid flow passages and the above second liquid flow passages corresponding thereto at all times, further comprising a seat to which the above movable separation organic film is physically or chemically joined, wherein the tip portion of a flow passage wall provided for dividing the above plurality of first liquid flow passages is pressed toward the joining area of the above movable separation organic film joined to the above seat, and the width W1 of the above tip portion is smaller than the width W2 of the above joining area.

According to the above liquid discharge head, the position of the end portion of the contact area with the flow passage wall of the movable separation organic film is shifted from the position of the fixed end (end portion of the joining area to the seat) of the movable area of the movable separation organic film, and when the movable member is displaced to the first liquid flow passage side accompanied with the generation of bubbles, the force by the end portion of the flow passage wall is not applied to the movable separation organic film, and therefore, the durability of the movable separation organic film is improved.

Furthermore, a liquid discharge head of the present invention of another mode is a liquid discharge head comprising: a first liquid flow passage connected to an outlet for discharging discharge liquid; a second liquid flow passage which has an element board with a heating element for generating bubbles in bubbling liquid and which corresponds to the above first liquid flow passage; and a movable separation film which substantially and mutually separates the above first liquid flow passage and the above corresponding second liquid flow passage at all times, further comprising a seat to which the above movable separation film is joined, wherein the above movable separation film is adhered through an adhesive area patterned to the above seat.

According to the above liquid discharge head, since the movable separation film is adhered on the element board through an adhesive area patterned to the above seat, the adhesive force of the fixing portion of the movable separation film becomes strong. As a result of that, since it is possible to respectively surely make the fixed part and the movable part of the movable separation film function as a fixed portion and a movable portion, the action of the movable separation film becomes stable, and as a result, a stable discharge characteristic can be obtained. Furthermore, since the adhesive area is formed by being patterned to the seat, the leak of adhesives to the unnecessary part is prevented and the movable range of the movable member is highly accurately ensured, and the discharge characteristics are stabilized. Furthermore, by using a silane coupling agent as an adhesive, the durability of the adhered part is improved.

A manufacturing method of a liquid discharge head of the present invention is a manufacturing method of a liquid discharge head which comprises: a first liquid flow passage connected to an outlet for discharging liquid; a second liquid flow passage having a heating element for generating bubbles in liquid; and a movable separation film substantially and mutually separating the above first liquid flow passage and the above second liquid flow passage at all times, comprising the steps of: forming a seat for supporting the above movable separation film with a clearance to the above heating element, on an element board where the above heating element is formed; forming a sacrificial layer at least at a position to be the above clearance of the above element board; forming the above movable separation film on the above seat covering the above sacrificial layer; performing etching from the rear of the above element board and forming a through hole in the above element board letting the above sacrificial layer be an etching stop layer; and eliminating the above sacrificial layer through the above through hole and forming the above second liquid flow passage.

According to the above manufacturing method of a liquid discharge head, since the movable separation film can be provided integrally on the element board, it does not occur to independently handle an extremely thin movable separation film in the manufacturing step, and the risk of damage of the movable separation film is eliminated. Accordingly, a liquid discharge head is manufactured, which has a small dispersion in discharge characteristics caused by the damage of the movable separation film and has a high reliability.

A manufacturing method of a liquid discharge head of the present invention of another mode is a manufacturing method of a liquid discharge head which comprises: a first liquid flow passage connected to an outlet for discharging liquid; a second liquid flow passage having a heating element for generating bubbles in liquid; and a movable separation film substantially and mutually separating the above first liquid flow passage and the above second liquid flow passage at all times, comprising the steps of: forming a sacrificial layer at a position to be the above second liquid flow passage on an element board where the above heating element is formed; forming adhesives covering the above sacrificial layer on the top of the above element board where the above sacrificial layer is formed; forming the above movable separation film on the top of the above adhesives; performing etching from the rear of the above element board and forming a through hole in the above element board letting the above sacrificial layer be an etching stop layer; eliminating the above sacrificial layer through the above through hole; and eliminating the above adhesives exposed by elimination of the above sacrificial layer, through the above through hole and forming the above second liquid flow passage.

According to the above manufacturing method of a liquid discharge head, the adhesives for adhering the movable separation film on the element board are accurately patterned while leaving only the fixed part of the movable separation film. Accordingly, a liquid discharge head is manufactured, in which the leak of adhesives or the failure of adhesion does not occur and the movable range of the movable separation film is highly accurately ensured and the dispersion in discharge characteristics is small. Furthermore, since the movable separation film is integrally provided on the element board, it does not occur to independently handle the movable separation film, the risk of damage the movable separation film is eliminated. As a result of that, a liquid discharge head which has a small dispersion in discharge characteristics caused by the damage of the movable separation film and has a high reliability is manufactured.

Furthermore, the present invention provides a head cartridge having the above liquid discharge head, and a liquid discharge device.

Moreover, as mentioned above, the present invention includes an invention based on the recognition of new problems created in the case of using an organic film as a material of the above separation film, and this invention will be understood by an example to be described later.

By the way, "up stream" and "down stream" used in the description of the present invention are used as the expression related to the flowing direction of the liquid going to the outlet through the bubble generating area (or the movable member) from the supply source of the liquid, or related to the direction in this configuration.

DETAILED DESCRIPTION OF THE PREFERRED EMBODIMENTS

Next, the embodiments of the present invention will be described by referring to drawings.

(First Embodiment)

Figure 1:
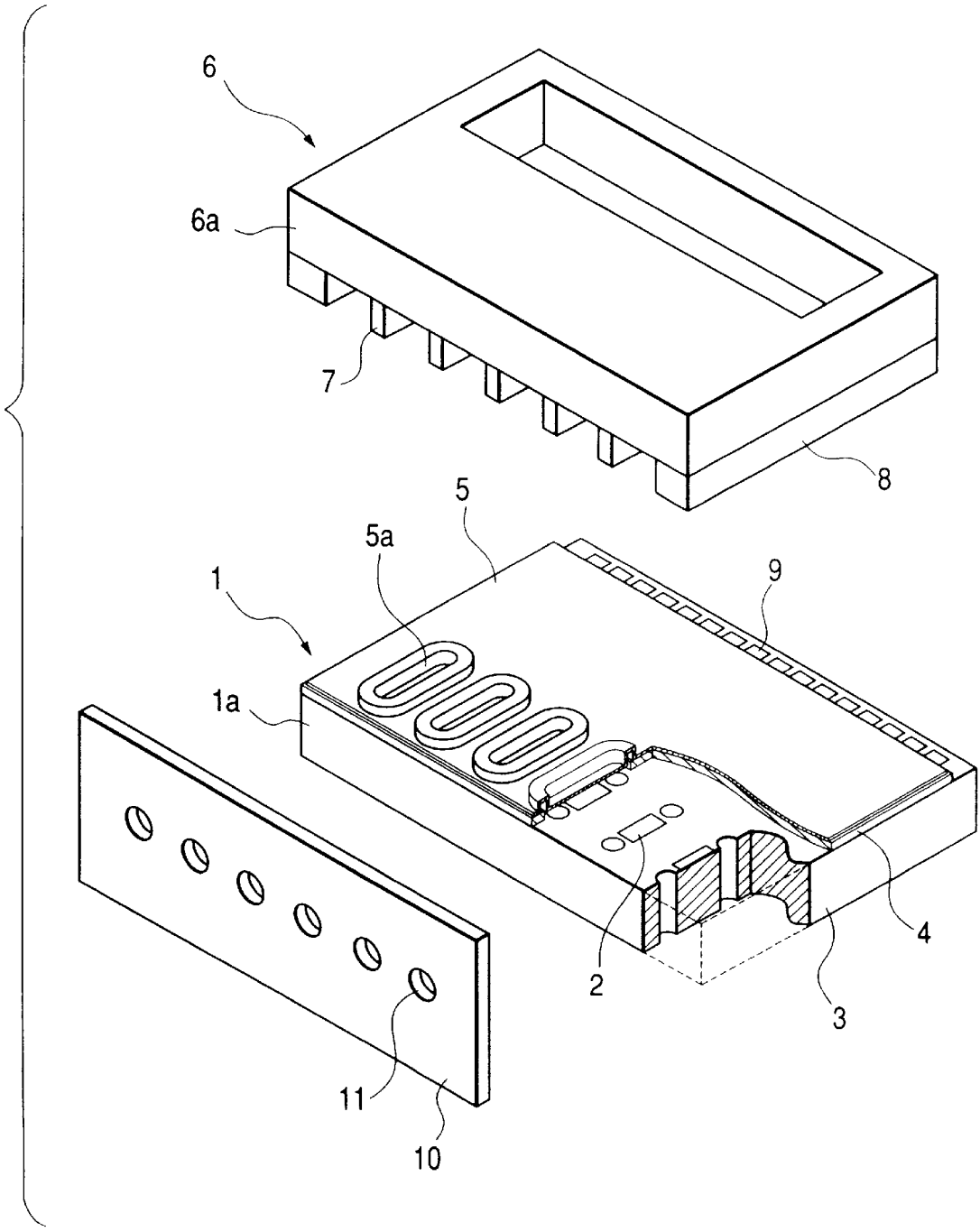
FIG. 1 is an exploded perspective illustration of a liquid discharge head of a first embodiment of the present invention.

FIG. 1 is an exploded perspective illustration of a liquid discharge head of a first embodiment of the present invention. Furthermore, FIG. 2 is a cross sectional view made by cutting the liquid discharge head shown in FIG. 1 along the liquid flow passage direction, and FIG. 3 is a cross sectional view along the arranging direction of the heating elements of the liquid discharge head shown in FIG. 1.

Figure 2:
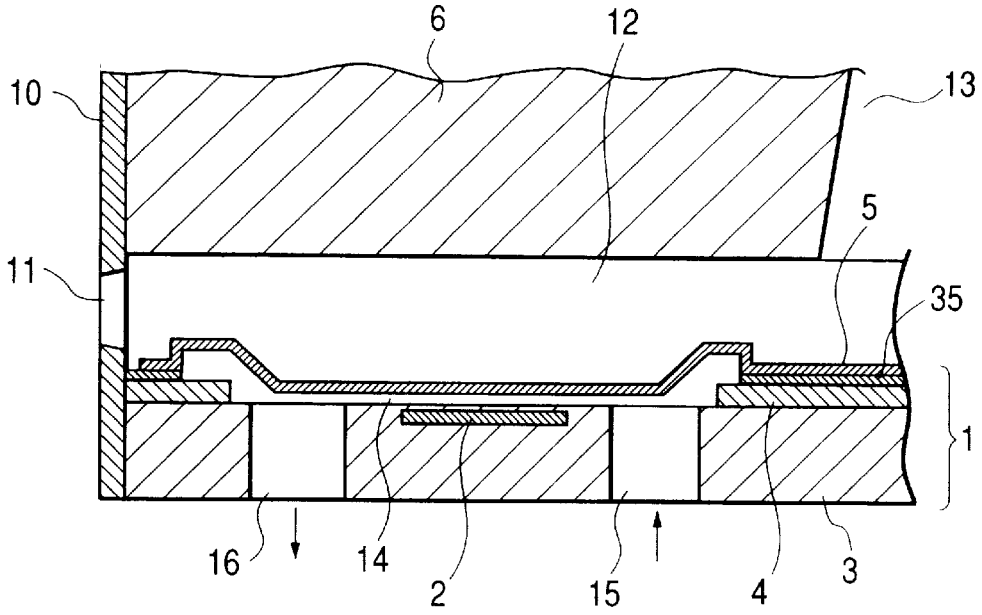
FIG. 2 is a cross sectional view along the liquid flow passage direction of the liquid discharge head shown in FIG. 1.
Figure 3:
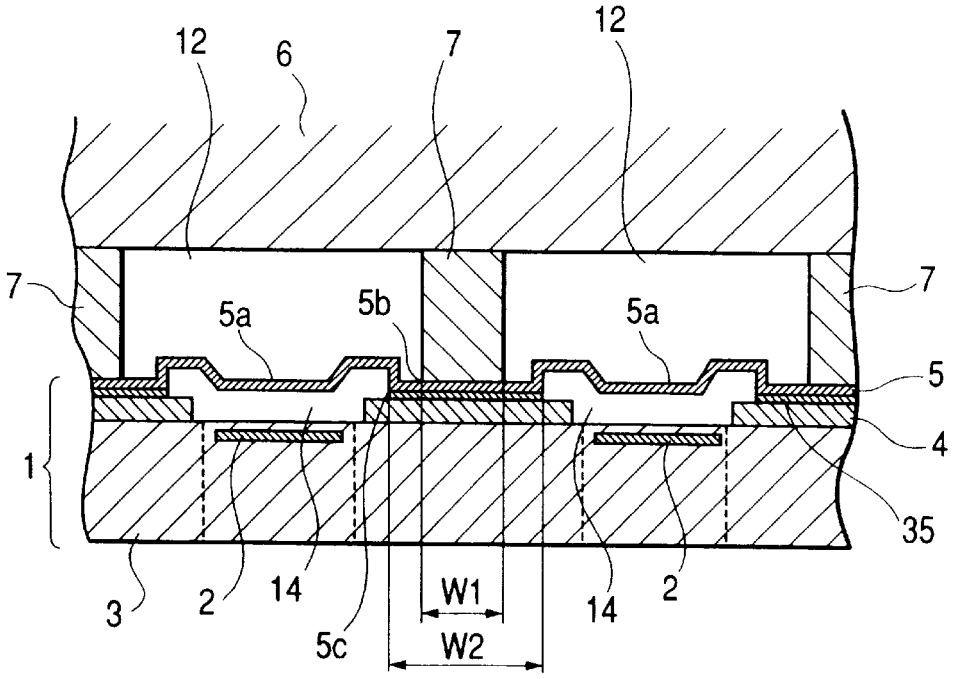
FIG. 3 is a cross sectional view along the arranging direction of heating elements of the liquid discharge head shown in FIG. 1.

As shown in FIG. 1 to FIG. 3, a liquid discharge head of the present embodiment comprises a liquid discharge head substrate 1 in which a plurality of heating elements 2 for respectively giving energy for generating bubbles to liquid are provided in parallel, a liquid flow passage integral type top board 6 joined on this liquid discharge head substrate 1, and an orifice plate 10 joined covering a front end face 1*a* of the liquid discharge head substrate 1 and a front end face 6*a* of the top board 6.

The liquid discharge head substrate 1 is a substance in which an elastic movable separation film 5 is provided on an element board 3 where the above heating element 2 is formed, through a seat 4. A part opposite to each heating element 2 of the movable separation film 5 is a movable portion 5*a* which is not in contact with the seat 4 but is supported with a clearance to the element board 3, and to each, the bubbling liquid is supplied by the element board 3, the seat 4, and the movable separation film 5, and a plurality of second liquid flow passages 14 are configured corresponding to the respective heating elements 2 by using the element board 3 as the bottom wall, the seat 4 as the side wall, and the movable separation film 5 as the upper wall. In the element board 3, a supply hole 15 for supplying bubbling liquid to a second liquid flow passage 14 and a discharging hole 16 for discharging the bubbling liquid supplied to the second liquid flow passage 14 from the second liquid flow passage 14 are formed.

Furthermore, in the element board 3, wiring (unillustrated) connected to each heating element 2 is formed, and in the meantime, an external contact pad 9 to be an input terminal of an electric signal from the outside is provided, and it is possible to separately drive each heating element 2 by applying voltage to a desired heating element 2 through the wiring from the external contact pad 9.

The top board 6 is a board for forming a plurality of first liquid flow passages 12 to which discharge liquid is respectively supplied and which correspond to the respective heating elements 2, and a common liquid chamber 13, and it is made by integrally forming flow passage walls 7 for dividing the respective first liquid flow passages 12, and a liquid chamber frame 8 configuring the common liquid chamber 13 for keeping temporally the discharge liquid to be supplied the respective first liquid flow passages 12.

In the orifice plate 10, a plurality of outlets 11 respectively connected to the respective first liquid flow passages 12 are formed.

The first liquid flow passage 12 and the second liquid flow passage 14 are completely divided by the movable separation film 5, and the discharge liquid in the first liquid flow passage 12 and the bubbling liquid in the second liquid flow passage 14 are supplied by using different supply routes, respectively.

The discharge liquid is supplied to the common liquid chamber 13 from an ink tank to be described later or the like, and it is discharged from the outlets 11 through the first liquid flow passage 12. The bubbling liquid is supplied to the second liquid flow passage 14 from the supply hole 15 so that the second liquid flow passage 14 may be filled up, and it is discharged from the discharge hole 16 accompanied with the production of bubbles by the drive of the heating element 2. In the present embodiment, the supply hole 15 is provided on the up stream side of the heating element 2 in regard to the flowing direction of the discharge liquid in the above first liquid flow passage 12, and the discharge hole 16 is provided on the down stream side of the heating element 2. Accordingly, the bubbling liquid flows in the same direction as the flowing direction of the discharge liquid in the first liquid flow passage 12 as shown by the arrow in FIG. 2, and it is moved or circulated using an unillustrated liquid moving route.

Here, the shape of a movable separation film 5 will be described in detail by referring to FIG. 2 and FIG. 3.

The movable separation film 5 is joined to the top of the seat 4, and the seat 4 has a shape in which an area configuring each second liquid flow passage 14 is hollowed, and a part covering this area is the movable portion 5*a*. The movable portion 5*a* is shaped more detailedly as follows: the movable separation film 5 once rises up toward the first liquid flow passage 12 side from the end portion of the fixed part to the seat 4, and after that, it is bent so as to turn over to the element board 3 side, and by doing so, the area opposite to the heating element 2 is made convex toward the heating element 2, and the peripheral portion thereof, that is, the area between the fixed part to the seat 4 and the area opposite to the heating element 2 is shaped to be convex toward the first liquid flow passage 12 side. In the second liquid flow passage 14, the area between the part opposite to the heating element 2 of the movable separation film 5 and the heating element 2 is called an bubble generating area.

Next, the manufacturing method of a liquid discharge head of the present embodiment will be described.

Figure 4A:
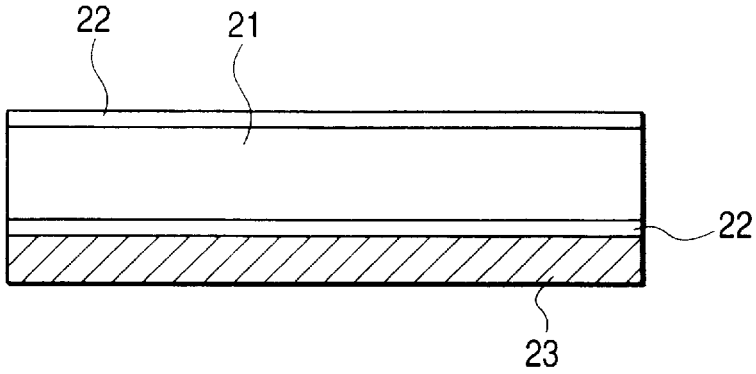
FIGS. 4A, 4B and 4C are figures showing the manufacturing step of a top board configuring the liquid discharge head of a first embodiment of the present invention.
Figure 4B:
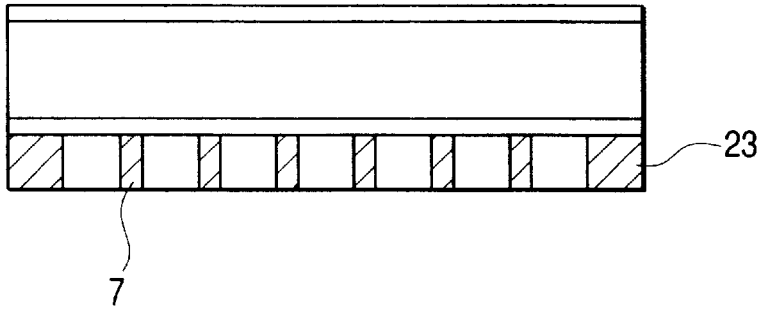
Figure 4C:
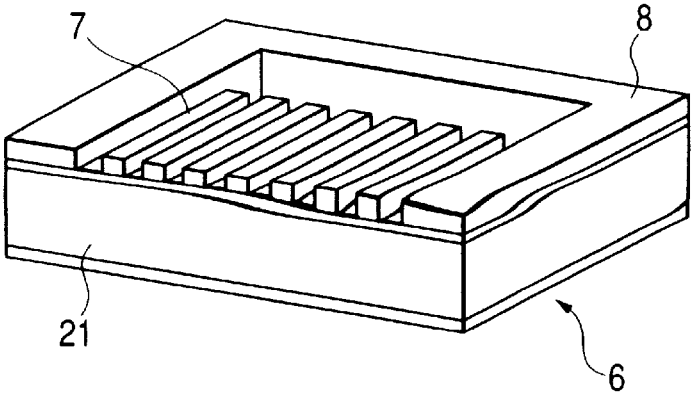
Figure 5A:
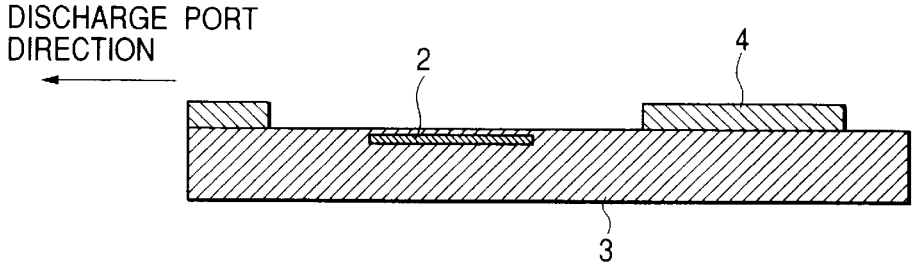
FIGS. 5A, 5B, 5C, 5D and 5E are cross sectional views along the liquid flow passage direction showing the manufacturing step of a liquid discharge head substrate configuring the liquid discharge head of the first embodiment of the present invention.
Figure 5B:
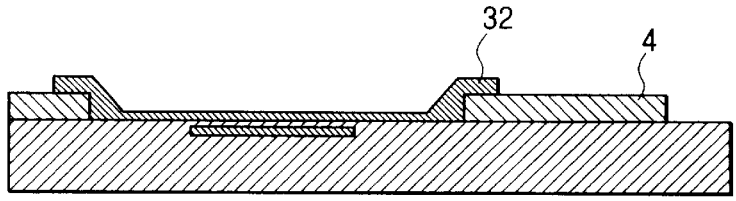
Figure 5C:
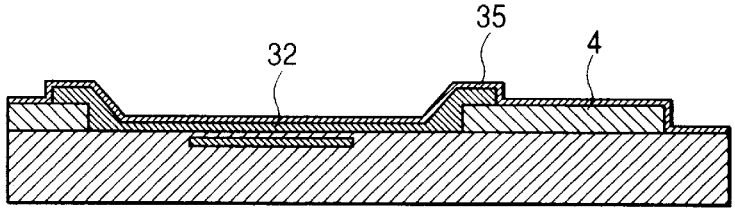
Figure 5D:
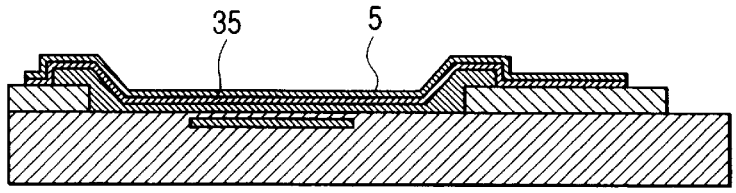
Figure 5E:
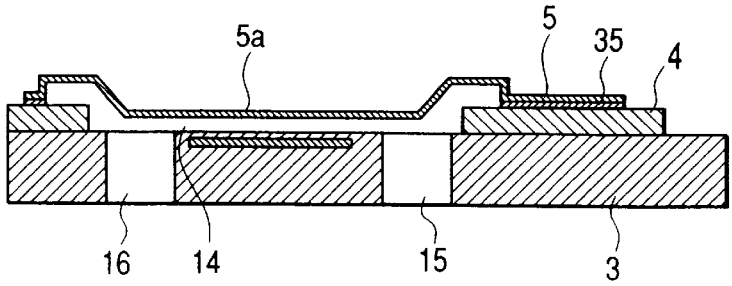
Figure 6A:
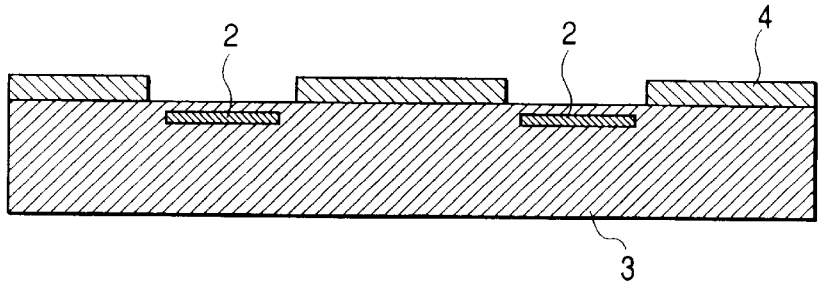
FIGS. 6A, 6B, 6C, 6D and 6E are cross sectional views along the arranging direction of the heating elements showing the manufacturing step of the liquid discharge head substrate configuring the liquid discharge head of the first embodiment of the present invention.
Figure 6B:
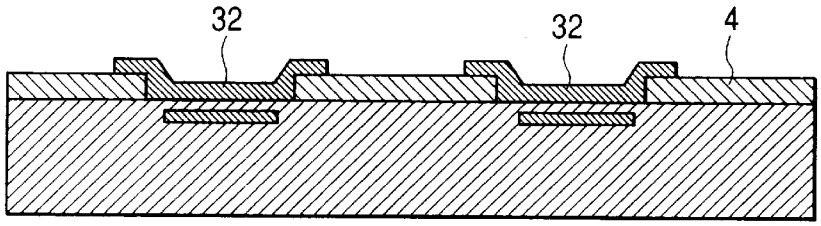
Figure 6C:
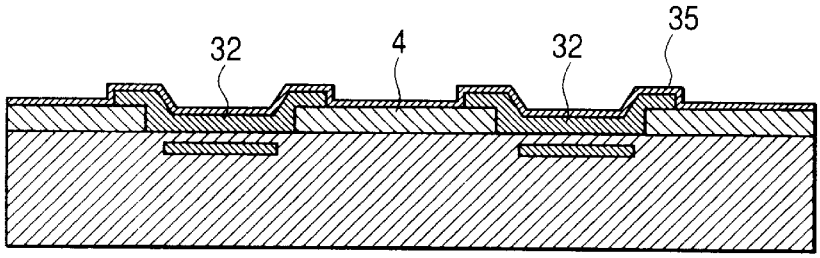
Figure 6D:
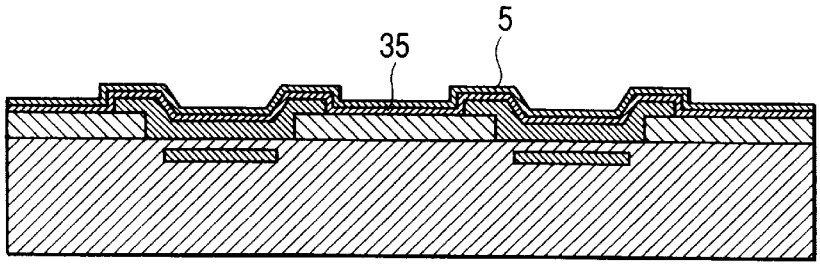
Figure 6E:
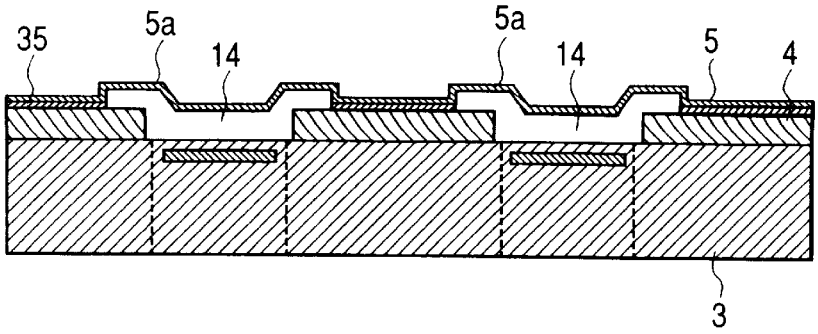

First, the manufacturing method of a top board 6 will briefly be described by referring to FIGS. 4A to 4C.

As shown in FIG. 4A, first, an $SiO_2$ film 22 with a thickness of about 1 cm is formed by thermal oxidation on both sides of a silicon wafer (Si board) 21, and after that, the part to be the above common liquid chamber is patterned by using a well known method such as the photo lithography. Then, on that, an SiN film 23 with a thickness of about 30 $\mu$m to be a flow passage wall was formed by the microwave CVD method (hereafter, referred to as $\mu$W-CVD method). Here, as a gas used in the formation of SiN film 23 by the $\mu$W-CVD method, a mixed gas of monosilane ($SiH_4$), nitrogen ($N_2$), and argon (Ar) is used. By the way, it is also possible to combine disilane ($Si_2H_6$), ammonia ($NH_3$) or the like besides the above substances as a component of the gas to be used.

In the present embodiment, the SiN film 23 was formed under a high vacuum of 5 [mTorr] by supplying a microwave (2.45 GHz) with a power of 1.5 [kW] and a gas flow rate of $SiH_4/N_2/Ar$=100/100/40 [sccm]. Furthermore, it is also possible to form the SiN film 23 by a CVD method using the RF power source or the like, and at another ratio of components.

Next, as shown in FIG. 4B, the part to be the flow passage wall 7 of the SiN film 23 and the part to be the common liquid chamber were patterned by using a well known method such as the photo lithography, and were etched to have the trench structure by using an etching device using dielectric junction plasma.

After that, as shown in FIG. 4C, by using tetramethylammonium-hydro-oxide (hereafter, referred to as TMAH), the part to be the opening of the common liquid chamber of the silicon wafer 21 is subjected to the silicon wafer penetration etching, so that a top board 6 integrated with the flow passage wall 7 and the liquid chamber frame 8 can be manufactured.

Next, by referring to FIGS. 5A to 5E and FIGS. 6A to 6E, the manufacturing method of a liquid discharge head substrate integrated with the movable separation film will be described. By the way, in the following description, the steps a to e correspond to FIGS. 5A to 5E and FIGS. 6A to 6E, respectively.

Step a:

To the total of the top of the element board 3 where the heating element 2 and an external contact pad 9 (refer to FIG. 1) or the like are formed, a TiW film with a thickness of about 5000 Å is formed by using the sputtering method as a protective layer for protecting the external contact pad 9. Next, on the TiW film, an SiN film with a thickness of about 10 $\mu$m is formed by the plasma CVD method, and the area except for the part to be the second liquid flow passage of this SiN film and the area where the external contact pad 9 is formed is patterned by using a well known method such as the photo lithography, and the seat 4 is formed. By the way, the element board 3 is made from silicon, and the heating element 2 is formed to this silicon by using the semiconductor manufacturing process.

Since the thickness of the SiN film determines the height of the second liquid flow passage, it is preferable to have a value so that the effect of the movable portion may be largest in terms of the total balance of the flow passage according to the supply mode of liquid to the second liquid flow passage or the like. Furthermore, SiN is generally used for the semiconductor process, and it is excellent in alkali resistance and has chemical stability.

Step b:

On the top of the element board 3 where the seat 4 is formed, an Al film with a thickness of about 5 $\mu$m is formed by the sputtering method, and the area except for the part to be the second liquid flow passage and the peripheral portion thereof is patterned by using a well known method such as the photo lithography, and a sacrificial layer 32 is formed. Consequently, the sacrificial layer 32 is formed to have a convex shape in the state where the peripheral portion thereof runs on the seat 4.

Step c:

On the top of the seat 4 and the sacrificial layer 32, a silane coupling agent to be the adhesive 35 is coated in a laminated state.

Step d:

On the top of the adhesive 35, a poly-para-xylylene film to be the movable separation film 5 with a thickness of about 2 $\mu$m is formed by the CVD method. The fundamental structure, manufacturing method, polymerization method or the like of poly-para-xylylene used in the present invention is disclosed in U.S. Pat. No. 3,379,803, Japanese Patent Publication No. 44-21353, Japanese Patent Publication No. 52-37479 or the like.

The obtained coating is excellent in heat resistance, and it is excellent in resistance to chemicals such as acid or alkali covering various kinds of organic solvents, and it is excellent in barrier properties of various kinds of substrates, and it is excellent in expansion and contraction following properties. Furthermore, since the formation of the coating is performed by the vapor phase polymerization method, the conformal (uniform) coating is also possible in details and a part with a complex shape.

Step e:

After forming an $SiO_2$ film with a film thickness of about 1 $\mu$m on the rear of the element board 3 by thermal oxidation, the opening parts of the supply hole 15 and the discharge hole 16 are patterned by using a well known method such as the photo lithography. Then, the cylindrical supply hole 15 and discharge hole 16 with a diameter of 10 to 50 $\mu$m are formed to the rear of the element board 3 by the trench structure etching by using an etching device using the dielectric junction plasma. At this moment, since the sacrificial layer 32 acts as an etching stop layer, the movable separation film 5 is not etched.

After that, the sacrificial layer 32 is eliminated by using a mixture of phosphoric acid, acetic acid, and hydrochloric acid, and further, the adhesive 35 is eliminated, so that the second liquid flow passage 14 may be formed. When eliminating the adhesive 35, the seat 4 acts as a mask of the solvent, and the solvent acts on the part where the sacrificial layer 32 is eliminated and the adhesive 35 is exposed. As a result of that, the solvent does not act on the area held between the seat 4 and the movable separation film 5, and therefore, the adhesive 35 remains only at the area to be the fixed portion to the seat 4 of the movable separation film 5, and the area in contact with the movable portion 5*a* of the movable separation film 5 is surely eliminated. That is, by this step, in the adhesive 35, the area in contact with the movable portion 5*a* of the movable separation film 5 is patterned.

Accordingly, in the movable separation film 5, only the part to be the fixed portion is fixed to the seat 4 through the adhesive 35, and it does not occur for the adhesive 35 to remain at the movable portion 5*a*. Furthermore, since the movable separation film 5 is fixed to the seat 4 through the adhesive 35, the fixing force of the movable separation film 5 is stronger than that in the case of directly fixing the movable separation film 5 to the seat 4. Consequently, the fixed portion of the movable separation film 5 is surely fixed to the seat 4, and as a result, the action of the movable portion 5*a* to be described later is stably performed, so that the discharge properties may be stable.

In case of fixing the movable separation film 5 configuring the second liquid flow passage 14 by adhesives, when the leak of adhesives or the failure of adhesion occurs, the action of the movable separation film 5 to be described later becomes unstable. Especially, when a dispersion occurs in the way of remaining of adhesives, a dispersion occurs in the movable range of the movable separation film 5, and as a result, a dispersion occurs in the discharge properties such as the amount of discharge. Therefore, like the present invention, after forming the movable separation film 5 on the adhesive 35, this adhesive 35 is eliminated from the rear side (second liquid flow passage side) of the movable separation film 5 so that only the part unnecessary for the adhesion of the movable separation film 5 may be eliminated and patterned, and consequently, the movable range of the movable separation film 5 can highly accurately be ensured. By doing this, the dispersion in the discharge properties becomes small. Especially, by using a silane coupling agent as adhesives, the durability of the part of adhesion is further improved.

At this moment, there are some cases where the adhesive 35 at the end portion of the joining area of the movable separation film 5 and the seat 4 is a little eliminated, but even when eliminated, only the coated adhesive 35 with a thickness of a level (about 5000 Å) is eliminated, and therefore, the width (W2 in FIG. 3) of the joining area is not practically affected.

The silane coupling agent used in the present embodiment is A-187 (manufactured by Nihon Unica Corporation). A-187 combines a part having a reactivity to an inorganic matter and a part (epoxide) having plenty of reactivity to an organic matter in 1 molecule, and it has an excellent property as an adhesive of an organic matter and an inorganic matter.

By the way, like the present embodiment, by letting the second liquid flow passage 14 be the liquid moving route and by providing a plurality of through holes of supply holes 15 and discharge holes 16 in the element board 3, the elimination of the sacrificial layer 32 and the adhesive 35 can be promoted.

As mentioned above, according to the manufacturing method of a liquid discharge head substrate 1 integrated with the movable separation film 5, since it does not occur to independently handle an extremely thin movable separation film 5 with a thickness of about 2 μm, the complication of a film attaching device and the risk of damaging a film when attaching the film can be prevented. Accordingly, the dispersion in discharge properties caused by the damage of the movable separation film 5 is decreased, and a liquid discharge head with a high reliability can be obtained.

Furthermore, since the movable separation film 5 is provided by being integrated with the element board 3 having the heating element 2, the positioning to the heating element 2 of the movable portion 5*a* is more accurately performed, so that the dispersion in discharge properties depending on the lot of products or the like can be restrained. Furthermore, since the second liquid flow passage 14 is formed by using the semiconductor manufacturing process, it is possible to narrow the flow passage pitch to an extent of 10 to 20 μm, and a high density of nozzles can easily be attained.

Next, the junction between the top board 6 and the liquid discharge head substrate 1 will be described.

In present embodiment, the top board 6 and the liquid discharge head substrate 1 are adhered by pressing the top board 6 alone or by mutually pressing both by using an unillustrated spring. At this moment, the flow passage wall 7 forming the first liquid flow passage 12 is adhered to the movable separation film 5 made from poly-para-xylylene as an organic resin film provided at the top of the side wall of the corresponding second liquid flow passage 14, and therefore, the sealing performance of the mutually adjacent first liquid flow passages 12 is improved.

In case of the present embodiment, as shown in the cross sectional view of FIG. 3, the width W2 of the junction area of the movable separation film 5 by the adhesive 35 to the seat 4 forming the second liquid flow passage 14 is wider than the width W1 of the contact area to the movable separation film 5 of the flow passage wall 7 forming the first liquid flow passage 12 of the top board 6. Accordingly, the position of the end portion 5*b* of the contact area to the flow passage wall 7 of the movable separation film 5 is shifted from the position of the part 5*c* (end portion of the junction area) to be the fixed end of the movable portion 5*a* of the movable separation film 5, and therefore, it is possible to provide a movable separation film 5 excellent in durability. Especially, it is more preferable from the view point of durability to use poly-para-xylylene as a material of the movable separation film 5.

By the way, by eliminating the intermediate part of the movable separation film 5 (poly-para-xylylene film) existing at the junction portion to the top board 6 of the liquid discharge head substrate 1 in a way of an embodiment to be described later, it is possible to perform the junction between the liquid discharge head substrate 1 and the top board 6 by low temperature (normal temperature) junction using surface activation (hereafter, referred to simply as normal temperature junction).

At this moment, the used normal temperature junction device comprises two vacuum chambers of a preparatory chamber and a pressure welding chamber, and the degree of vacuum is 1 to 10 [Pa]. Then, in the preparatory chamber, the alignment positions for positioning the parts for joining the liquid discharge head substrate 1 and the top board 6 are made in the fitted state by using an image processing. After that, while keeping that state, they are transferred to the pressure welding chamber, and the energy particles are radiated on the surface of the SiN film of the part to be joined by using the saddle field type high speed electron beam. After activating the surface by this radiation, the liquid discharge head substrate 1 and the top board 6 are joined. At this moment, in order to raise the strength, the heating at a temperature of 200 or less degrees or the pressurizing may be performed.

By the way, as the elimination area of poly-para-xylylene, the area to be joined to the top board 6 is sufficient in case of a low arranging density of nozzle lines, but in case of arranging the nozzle lines at a high density, it is preferable to perform the elimination with an allowance of about 5 to 10 $\mu$m in addition to the area to be joined to the top board 6 from the view point of the accuracy when adhering (or joining) the top board 6 and the liquid discharge head substrate 1.

Furthermore, as the above junction method, it is also possible to use a method in which a water glass (sodium silicate) of a thin film (3000 Angstroms) is coated to the junction part on the liquid discharge head substrate 1 and after the patterning, it is heated at a temperature of about 100 degrees to be joined to the top board 6, or a method in which after coating adhesives to either the liquid discharge head substrate 1 or the top board 6 by using the transferring method or the like, the junction by heating and pressurizing is performed.

Then, after the adhesion or the junction of the liquid discharge head substrate 1 and the top board 6, an orifice plate 10 is joined, so that a liquid discharge head may be accomplished.

The orifice plate 10 is also made from a material of the silicon family, and for example, it is formed by shaving a silicon board where outlets 11 is formed to a thickness of about 10 to 150 $\mu$m. By the way, the orifice plate 10 is not always necessary for the constitution of the present invention, and it is also possible to make a top board with outlets in such a way in which instead of providing an orifice plate 10, a wall with a thickness worth the orifice plate 10 is left at the tip face of the top board 6 when forming the flow passage wall 7 on the top board 6 and outlets 11 are formed at this part.

Next, the discharge of liquid in a liquid discharge head of the present embodiment will be described by referring to FIGS. 7A to 7E. FIGS. 7A to 7E are schematic cross sectional views in the flow passage direction for describing the state of discharge of liquid of the liquid discharge head shown in FIG. 1 to FIG. 3 in a way of the time series. By the way, in FIGS. 7A to 7E, the adhesive 35 (refer to FIG. 2 or the like) for fixing the movable separation film 5 to the seat 4 is omitted.

In FIGS. 7A to 7E, the first liquid flow passage 12 directly connected to the outlet 11 is filled up with the discharge liquid supplied from the common liquid chamber 13, and further, the second liquid flow passage 14 having the bubble generating area is filled up with the bubbling liquid which bubbles by being given thermal energy by the heating element 2.

Figure 7A:
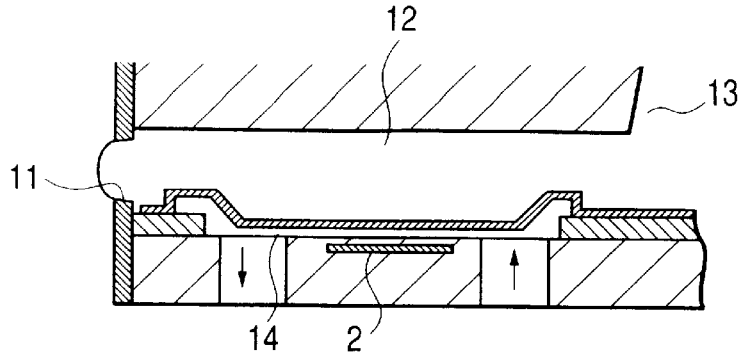
FIGS. 7A, 7B, 7C, 7D and 7E are schematic cross sectional views in the flow passage direction for describing the state of discharge of liquid of the liquid discharge head of the first embodiment of the present invention in a way of the time series.

In the initial state shown in FIG. 7A, the discharge liquid in the first liquid flow passage 12 is pulled in to the neighborhood of the outlet 11 by the capillary force. By the way, in the present embodiment, the outlet 11 is positioned on the down stream side in regard to the flowing direction of the liquid in the first liquid flow passage 12 relative to the projection area to the first liquid flow passage 12 of the heating element 2. By the way, the bubbling liquid flows and moves in the direction shown by the arrow in the second liquid flow passage 14 as mentioned above.

Figure 7B:
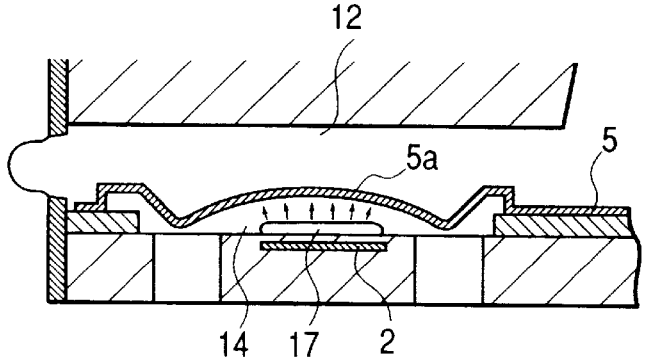

In this state, when the thermal energy is given to the heating element 2, the heating element 2 is rapidly heated, and the bubbling liquid is heated to bubble by the surface in contact with the bubbling liquid in the bubble generating area (FIG. 7B). The bubble 17 created by these heating and bubbling is a bubble based on such a film boiling phenomenon as described in U.S. Pat. No. 4,723,129, and it is created on the total area of the surface of the heating element 2 accompanied with an extremely high pressure at the same time. The pressure generated at this moment is transmitted through the bubbling liquid in the second liquid flow passage 14 as a pressure wave, and it acts on the movable separation film 5, and consequently, the movable portion 5*a* of the movable separation film 5 is displaced, and the discharge of the discharge liquid in the first liquid flow passage 12 is started.

Figure 7C:
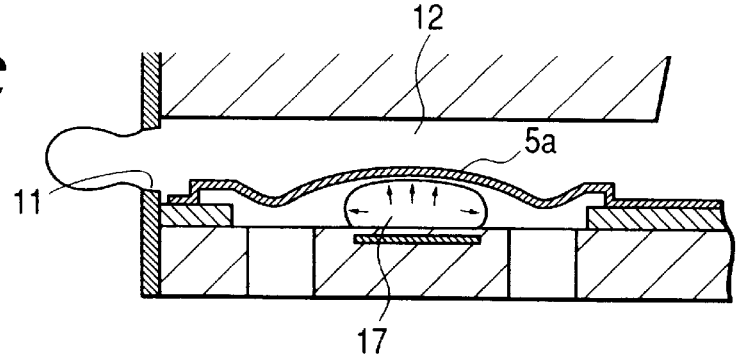
Figure 7D:
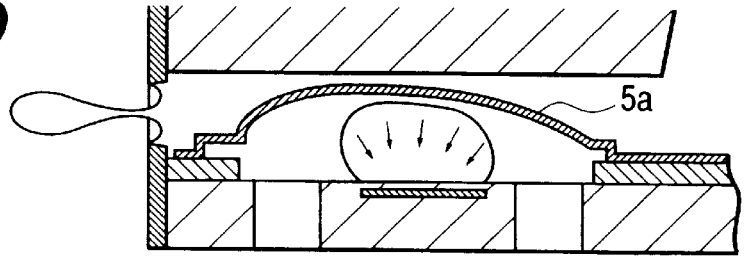
Figure 7E:
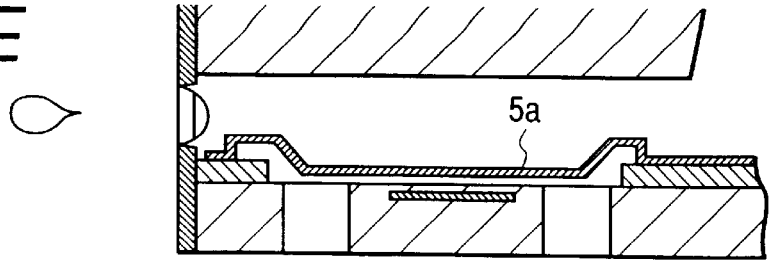

When the bubble 17 created on the total of the surface of the heating element 2 grows rapidly, it becomes filmy (FIG. 7C). The expansion of the bubble 17 by an extremely high pressure at the beginning of generation further displaces the movable portion 5*a,* and consequently, the discharge of the discharge liquid in the first liquid flow passage 12 from the outlet 11 progresses. After that, when the bubble 17 further grows, the displacement of the movable portion 5*a* is increased (FIG. 7D), and after that, when the bubble is debubbled, the movable portion 5*a* is also displaced to return to the initial state shown in FIG. 7A by the restoring force of itself (FIG. 7E).

As mentioned above, in the liquid discharge head of the present embodiment, the movable separation film 5 is supported on the element board 3 by the seat 4, and the movable portion 5*a* thereof is convex to the second liquid flow passage 14 side and faces to the heating element 2. Consequently, since the movable portion 5*a* is arranged near the heating element 2, the pressure based on the production of the bubble 17 acts on the movable portion 5*a* more efficiently. Accordingly, even if the pressure accompanied with the occurrence of the bubble 17 is transmitted to the discharge liquid through the movable separation film 5, the discharge liquid can be discharged at a high discharge efficiency.

Furthermore, since the movable portion 5*a* is in advance projected to the second liquid flow passage 14 side, the amount of displacement when the movable portion 5*a* is displaced so as to guide the pressure transmitting direction of the bubble 17 to the outlet direction is increased by the pressure based on the production of the bubble 17, and this also largely contributes for the improvement of the discharge efficiency of the discharge liquid. In respect to the amount of displacement of this movable portion 5*a,* in the present embodiment, the movable separation film 5 is not joined to the end portion on the heating element 2 side of the seat 4, and consequently, the structure is made so that the area of the movable portion 5*a* can be enlarged and the amount of displacement of the movable portion 5*a* can further be increased.

Furthermore, since the movable portion 5*a* of the movable separation film 5 is shaped so that the peripheral portion may be convex to the first liquid flow passage 12 side, at least 2 pieces of bent portions exist between the joining portion to the seat 4 of the movable separation film 5 and the area opposite to the heating element 2. Accordingly, when the movable portion 5*a* of the movable separation film 5 is displaced, the force applied to the joining portion to the seat 4 can be decreased or eliminated, and the durability of the joining portion is improved. As a result of that, as mentioned above, the movable separation film 5 is fixed to the seat 4 through the adhesive 35, and in addition to that, by combining the improvement of the accuracy of assembly in manufacturing, it is possible to make the movable portion 5*a* of the movable separation film 5 and the fixed portion surely function as the movable portion and the fixed portion, respectively, so that a highly fine output image can stably be obtained.

In addition to that, in the present embodiment, since the top board 6 is made from a material containing a silicon element, the heat radiation efficiency of the head is improved when compared with that in the case of making the top board from resin or the like. Furthermore, by forming the flow passage wall 7 configuring the first liquid flow passage 12 from SiN, the ink resistance is further raised. By such an additional structure, the above effect of the present embodiment of stably obtaining a highly fine output image is made more excellent synergistically.

(Second Embodiment)

Figure 8:
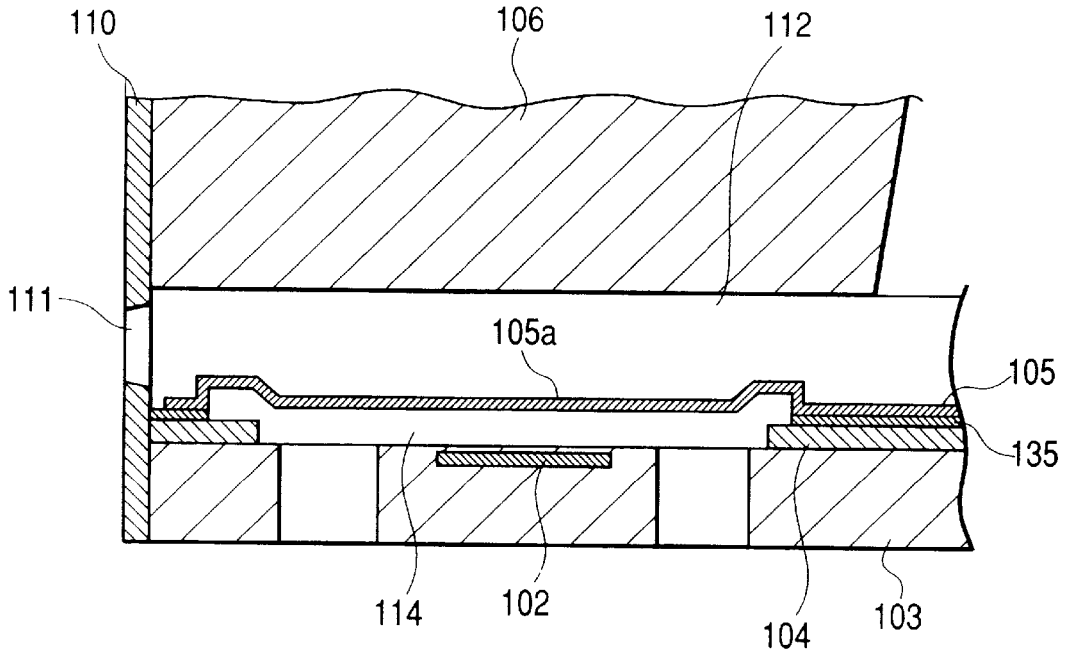
FIG. 8 is a cross sectional view along the liquid flow passage direction of the liquid discharge head of a second embodiment of the present invention.
Figure 9:
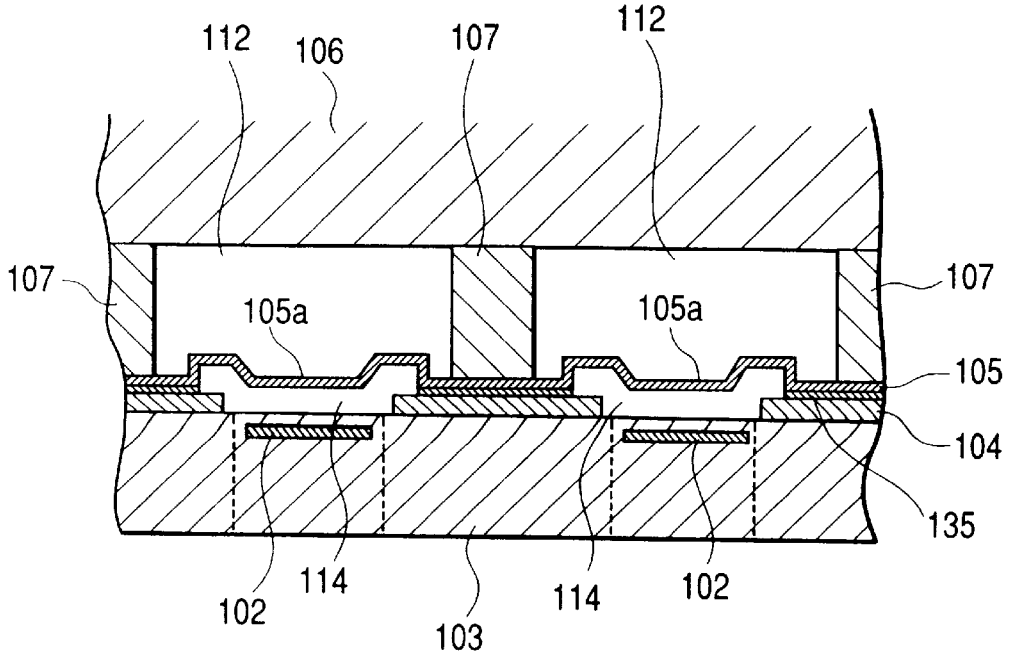
FIG. 9 is a cross sectional view along the arranging direction of the heating elements of the liquid discharge head of the second embodiment of the present invention.
Figure 10A:
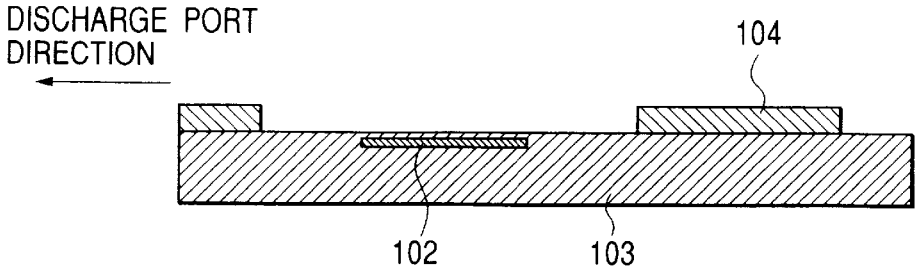
FIGS. 10A, 10B, 10C, 10D, 10E and 10F are cross sectional views along the liquid flow passage direction showing the manufacturing step of a liquid discharge head substrate configuring the liquid discharge head of the second embodiment of the present invention.
Figure 10B:
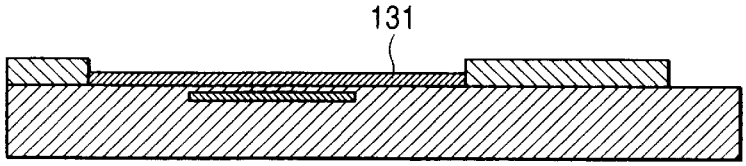
Figure 10C:
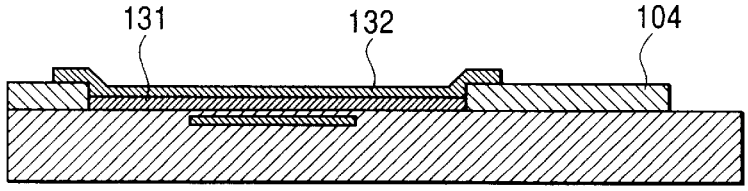
Figure 10D:
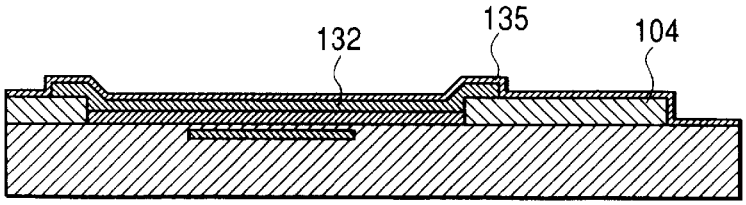
Figure 10E:
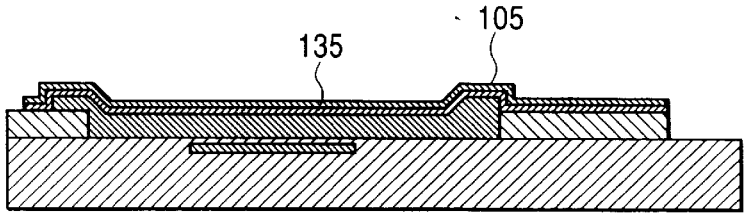
Figure 10F:
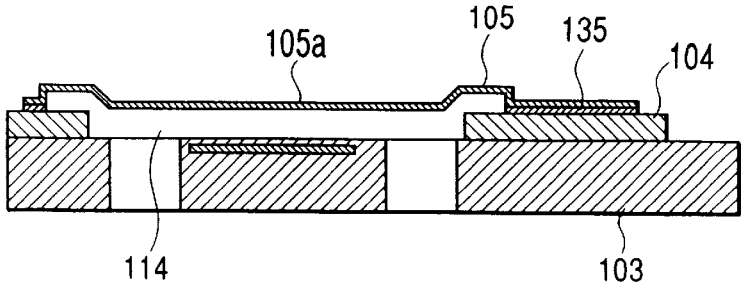
Figure 11A:
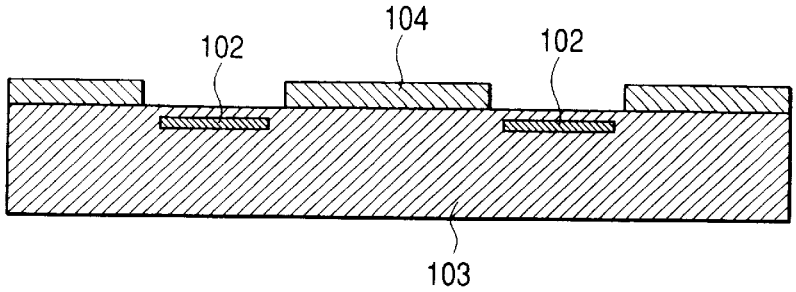
FIGS. 11A, 11B, 11C, 11D, 11E and 11F are cross sectional views along the arranging direction of the heating elements showing the manufacturing step of a liquid discharge head substrate configuring the liquid discharge head of the second embodiment of the present invention.
Figure 11B:
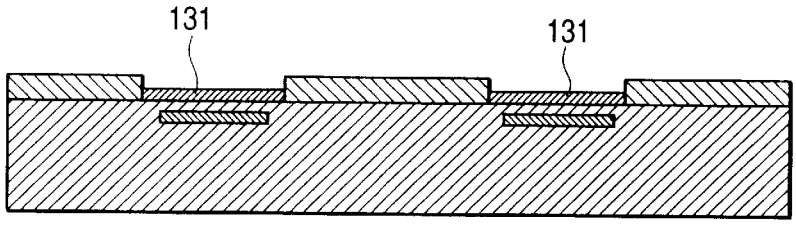
Figure 11C:
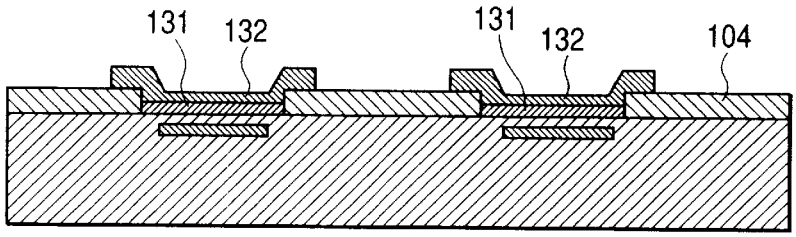
Figure 11D:
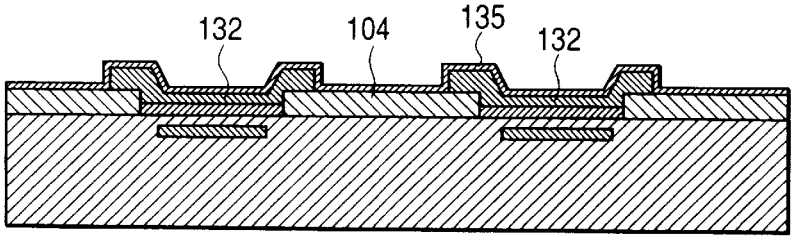
Figure 11E:
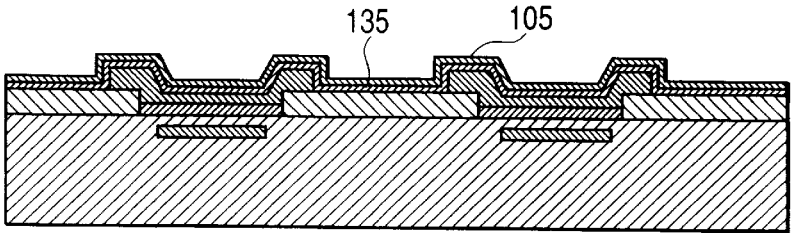
Figure 11F:
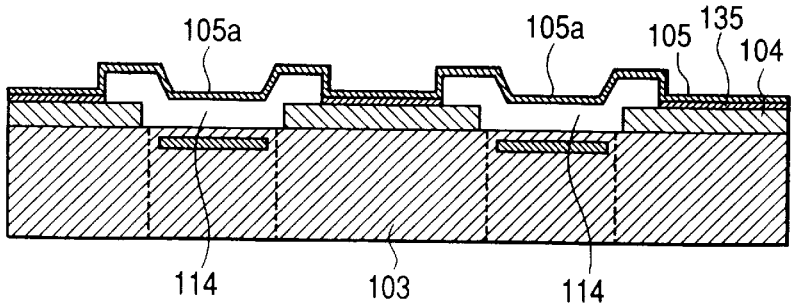

FIG. 8 and FIG. 9 are cross sectional views of a liquid discharge head which is a second embodiment of the present invention, and FIG. 8 shows a cross sectional view along the liquid flow passage direction, and FIG. 9 shows a cross sectional view along the arranging direction of heating elements.

The liquid discharge head of the present embodiment also has the same basic constitution as that of the first embodiment. That is, on an element board 103 where a plurality of heating elements 102 are provided in parallel, a seat 104 for supporting a movable separation film 105 is provided, and on this seat 104, a movable separation film 105 is adhered through an adhesive 135, so that a liquid discharge head substrate having a plurality of second liquid flow passages 114 corresponding to the heating elements 102 may be configured. Then, on that, a top board 106 where a plurality of flow passage walls 107 positioned between the respective heating elements 102 are integrally provided is joined, so that first liquid flow passages 112 corresponding to the second liquid flow passages 114 may be configured. Furthermore, an orifice plate 110 is joined covering the front of the liquid discharge head substrate and the front of the top board 106. In the orifice plate 110, a plurality of outlets 111 respectively connected to the respective first liquid flow passages 112 are formed.

Here, the movable separation film 105 completely separating the first liquid flow passages 112 and the second liquid flow passages 114 are shaped similar to that of the first embodiment, and the movable portion 105*a* opposite to the heating element 102 is convex toward the second liquid flow passage 114 side. However, the amount of projection thereof is smaller than that of the first embodiment, and the distance between the heating element 103 and the movable portion 105*a* is larger than that of the first embodiment.

Next, the manufacturing method of a liquid discharge head of the present embodiment will be described.

The liquid discharge head of the present embodiment is manufactured similarly to that of the first embodiment in a such way where the top board 106 is joined to the liquid discharge head substrate and further, the orifice plate 110 is joined. Here, since the manufacturing method of the top board 106 and the orifice plate 110 is similar to that of the first embodiment, the description thereof will be omitted, and the manufacturing method of the liquid discharge head substrate will be described below by referring to FIGS. 10A to 10F and FIGS. 11A to 11F. By the way, in the following description, the steps a to f correspond to FIGS. 10A to 10F and FIGS. 11A to 11F, respectively.

Step a:

On the total of the top of the element board 103 where the heating element 102 and an external contact pad (unillustrated) or the like are formed, a TiW film with a film thickness of about 5000 Å is formed by using the sputtering method as a protective layer for protecting an external contact pad. Next, on the TiW film, an SiN film with a thickness of about 10 $\mu$m is formed by the plasma CVD method, and the area except for the part to be the second liquid flow passage of this SiN film and the area where the external contact pad is formed is patterned by using a well known method such as the photo lithography, so that the seat 104 may be formed. By the way, the element board 103 is made from silicon, and the heating element 102 is formed by using the semiconductor manufacturing process to this silicon.

Step b:

An Al film with a thickness of about 5 $\mu$m is buried in the part to be the second liquid flow passage, and a first sacrificial layer 131 is formed.

Step c:

On the top of the seat 104 and the first sacrificial layer 131, an Al film with a thickness of about 5 $\mu$m is formed by the sputtering method, and the area except for the part to be the second liquid flow passage and the peripheral portion thereof is patterned by using a well known method such as the photo lithography to form a second sacrificial layer 132. At this moment, a difference in level is created between the first sacrificial layer 131 and the seat 104, and the height of the seat 104 is higher than the height of the first sacrificial layer 131, and therefore, the second sacrificial layer 132 is formed into a convex shape in the state where the peripheral portion thereof runs on the seat 104.

Step d:

On the top of the seat 104 and the second sacrificial layer 132, a silane coupling agent to be an adhesive 135 is coated.

Step e:

On the top of the adhesive layer 135, a poly-para-xylylene film to be the movable separation film 105 with a film thickness of about 2 $\mu$m is formed by the CVD method.

Step f:

After forming an $SiO_2$ film with a film thickness of about 1 $\mu$m on the rear of the element board 103 by thermal oxidation, the opening parts of the supply hole and the discharge hole are patterned by using a well known method such as the photo lithography. Then, the cylindrical supply hole and discharge hole with a diameter of 10 to 50 $\mu$m are formed to the rear of the element board 103 by the trench structure etching by using an etching device using the dielectric junction plasma. At this moment, since the first sacrificial layer 131 acts as an etching stop layer, the movable separation film 105 is not etched.

After that, the first sacrificial layer 131 and the second sacrificial layer 132 are eliminated by using a mixture of phosphate, acetic acid, and hydrochloric acid, and further, the adhesive 135 is eliminated, so that the second liquid flow passage 114 may be formed. Consequently, similarly to the first embodiment, the adhesive 135 is left only at the fixed part of the movable separation film 105 to the seat 104, and it is not left at the movable portion 105*a*.

As mentioned above, a liquid discharge head substrate where a movable separation film 105 with a distance from the surface of the element board 103 to the movable portion 105*a* of about 10 $\mu$m is formed is obtained.

In the liquid discharge head using a liquid discharge head substrate like this, similarly to the first embodiment, it does not occur to independently handle the movable separation film 105, and therefore, a defect related to the attachment of a film can be prevented, and further, there is an effect of improving the discharge efficiency and of being able to stably obtain a highly fine output image due to the shape of the movable portion 105*a* of the movable separation film 105.

Furthermore, in the liquid discharge head of the present embodiment, when forming the movable separation film 105, the sacrificial layer is made to have a two-layer structure, and therefore, it is possible to have a certain distance between the movable portion 105*a* and the heating element 102 while making the movable separation film 105 so that the movable portion 105*a* thereof may be convex toward the second liquid flow passage 114. Consequently, the influence of heat to the movable portion 105*a* is decreased in the course from the production of bubbles when discharging liquid to the debubbling. That is, when selecting a material of the movable separation film 105, the limit as for the heat resistance is relieved, and therefore, the range of selection of a material of the movable separation film 105 can be widened.

By the way, in the present embodiment, the distance between the movable portion 105*a* and the heating element 102 is enlarged by providing a plurality of sacrificial layers, but it is also possible to enlarge the distance between the movable portion 105*a* and the heating element 102 by a single sacrificial layer with a large film thickness. However, in case of a shape of making the peripheral portion of the movable portion 105*a* convex to the first liquid flow passage 112 side like the present embodiment, the height of the peripheral portion of the movable portion 105*a* also becomes higher when the film thickness of the sacrificial layer is increased. In the case where the distance between the top board 106 and the element board 103 is constant, when the height of the peripheral portion of the movable portion 105*a* becomes higher, a disorder may easily occur in the flow of liquid in the first liquid flow passage 112, and there is a tendency for the discharge of liquid or the refill (supplementation of liquid from the up stream side in the first liquid flow passage 112) to be unstable. Accordingly, in the case when the movable portion 105*a* has such a shape as shown in the present embodiment, it is preferable to form the sacrificial layer separately by a plurality of times of operations so that the height of the peripheral portion of the movable portion 105*a* may not be too high.

(Third Embodiment)

Figure 12:
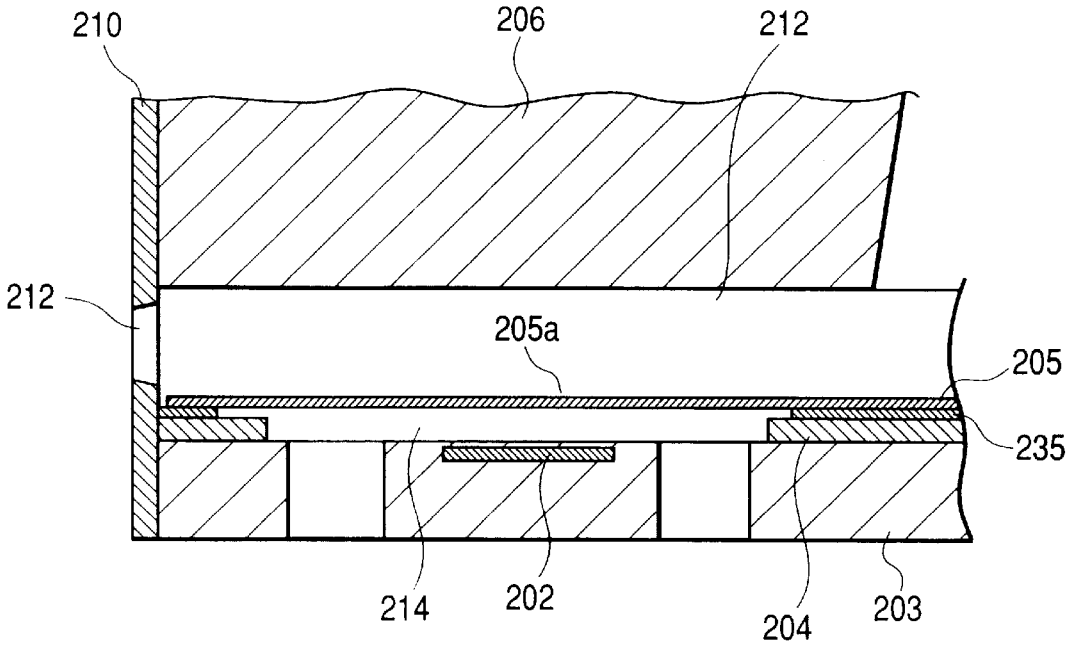
FIG. 12 is a cross sectional view along the liquid flow passage direction of the liquid discharge head of a third embodiment of the present invention.
Figure 13:
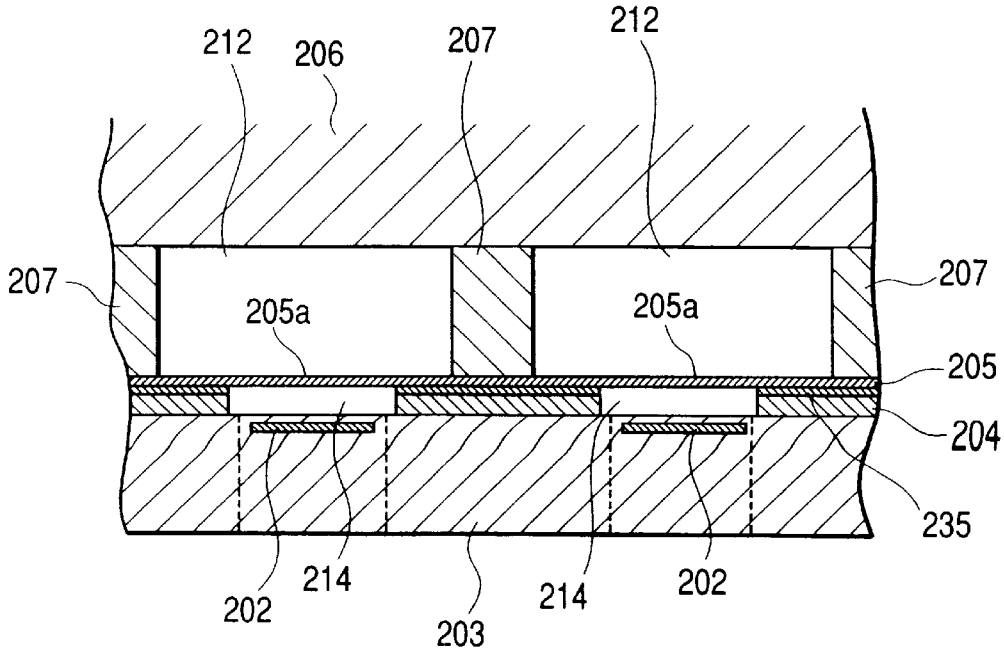
FIG. 13 is a cross sectional view along the arranging direction of the heating elements of the liquid discharge head of the third embodiment of the present invention.
Figure 14A:
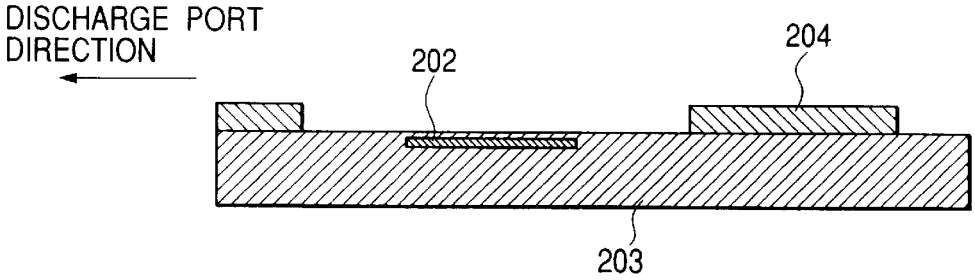
FIGS. 14A, 14B, 14C, 14D and 14E are cross sectional views along the liquid flow passage direction showing the manufacturing step of a liquid discharge head substrate configuring the liquid discharge head of the third embodiment of the present invention.
Figure 14B:
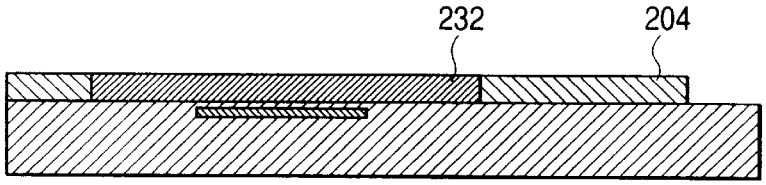
Figure 14C:
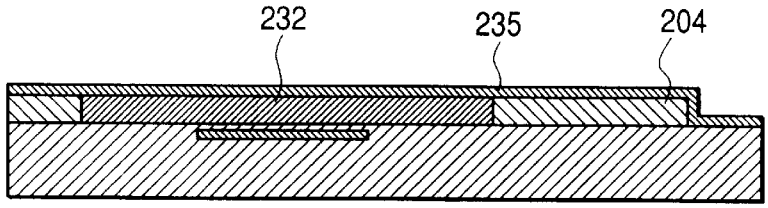
Figure 14D:
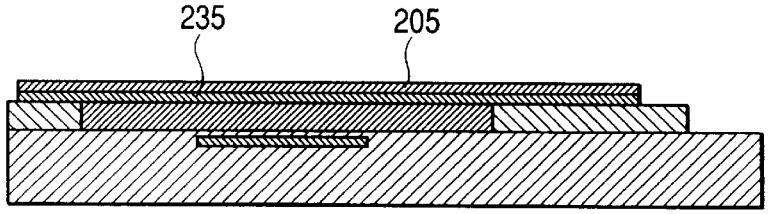
Figure 14E:
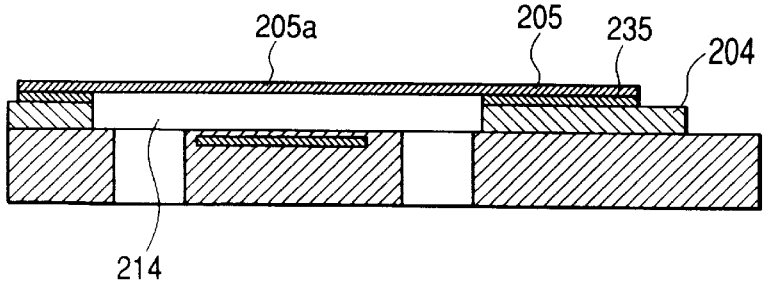
Figure 15A:
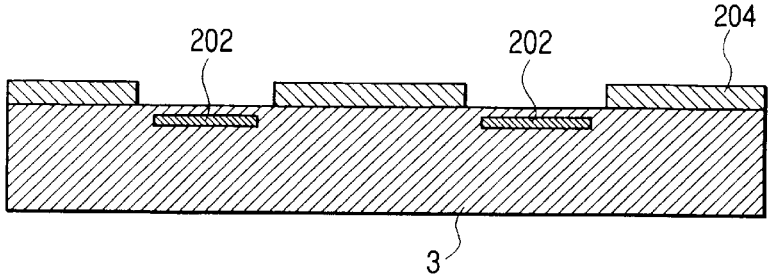
FIGS. 15A, 15B, 15C, 15D and 15E are cross sectional views along the arranging direction of the heating elements showing the manufacturing step of a liquid discharge head substrate configuring the liquid discharge head of the third embodiment of the present invention.
Figure 15B:
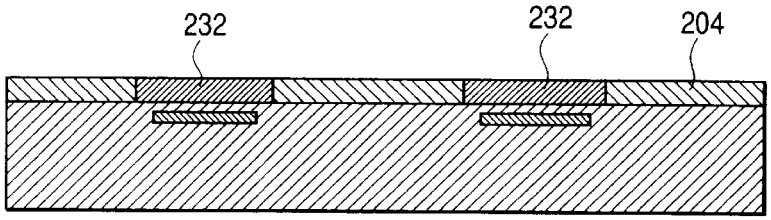
Figure 15C:
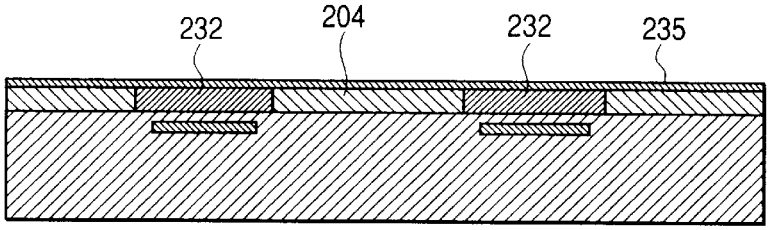
Figure 15D:
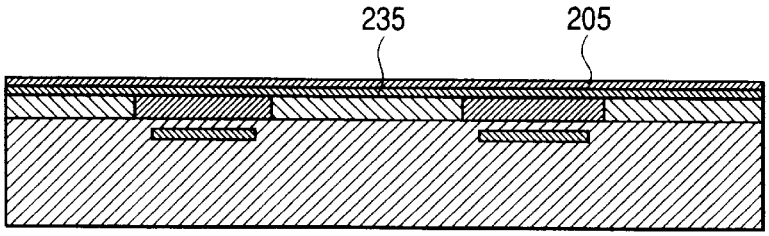
Figure 15E:
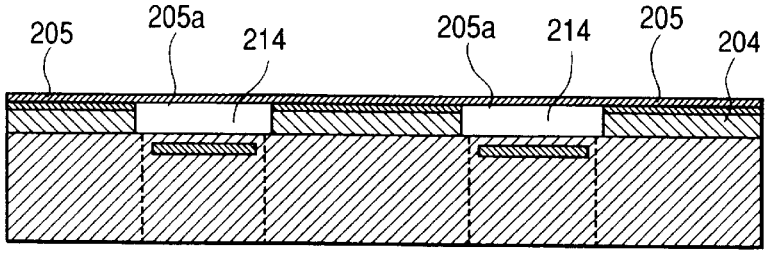

FIG. 12 and FIG. 13 are cross sectional views of a liquid discharge head which is a third embodiment of the present invention, and FIG. 12 shows a cross sectional view along the liquid flow passage direction, and FIG. 13 shows a cross sectional view along the arranging direction of the heating elements.

The liquid discharge head of the present embodiment also has the same basic constitution as that of the first embodiment. That is, on an element board 203 where a plurality of heating elements 202 are provided in parallel, a seat 204 is provided, and on this seat 204, a movable separation film 205 is formed through an adhesive 235, and a liquid discharge head substrate having a plurality of second liquid flow passages 214 corresponding to the heating elements 202 is configured. Then, on that, a top board 206 where a plurality of flow passage walls 207 positioned between the respective heating elements 202 are integrally provided is joined, and first liquid flow passages 212 corresponding to the second liquid flow passages 214 are configured. Furthermore, an orifice plate 210 is joined covering the front of the liquid discharge head substrate and the front of the top board 206. In the orifice plate 210, a plurality of outlets 211 respectively connected to the respective first liquid flow passages 212 are formed.

Here, the movable separation film 205 completely separating the first liquid flow passages 212 and the second liquid flow passages 214 is formed as a flat film, and the distance between the surface of the element board 203 and the movable portion 205*a* is equal to the height of the seat 204.

Next, the manufacturing method of a liquid discharge head of the present embodiment will be described.

The liquid discharge head of the present embodiment is also manufactured similarly to the first embodiment in such a way in which the top board 206 is joined to the liquid discharge head substrate and further, the orifice plate 210 is joined. Here, since the manufacturing method of the top board 206 and the orifice plate 210 is similar to that of the first embodiment, the description thereof will be omitted, and the manufacturing method of the liquid discharge head substrate will be described below by referring to FIGS. 14A to 14E and FIGS. 15A to 15E. By the way, in the following description, the steps a to e correspond to FIGS. 14A to 14E and FIGS. 15A to 15E, respectively.

Step a:

On the total of the top of the element board 203 where the heating element 202 and an external contact pad (unillustrated) or the like are formed, a TiW film with a film thickness of about 5000 Å is formed by using the sputtering method as a protective layer for protecting the external contact pad. Next, on the TiW film, an SiN film with a thickness of about 10 $\mu$m is formed by the plasma CVD method, and the area except for the part to be the second liquid flow passage of this SiN film and the area where the external contact pad is formed is patterned by using a well known method such as the photo lithography, so that the seat 204 may be formed. By the way, the element board 203 is made from silicon, and the heating element 202 is formed by using the semiconductor manufacturing process to this silicon.

Step b:

An Al film with a thickness of about 10 $\mu$m is buried in the part to be the second liquid flow passage, and a sacrificial layer 231 is formed. Consequently, the part to be the second flow passage is completely buried, and the surface of the seat 203 and the surface of the sacrificial layer 231 become the same flat surface.

Step c:

On the top of the seat 204 and the sacrificial layer 231, a silane coupling agent to be an adhesive 235 is coated.

Step d:

On the top of the adhesive 235, a poly-para-xylylene film to be the movable separation film 205 with a film thickness of about 2 $\mu$m is formed by the CVD method.

Step e:

After forming an $SiO_2$ film with a film thickness of about 1 $\mu$m on the rear of the element board 203 by thermal oxidation, the opening parts of the supply hole and the discharge hole are patterned by using a well known method such as the photo lithography. Then, the cylindrical supply hole and discharge hole with a diameter of 10 to 50 $\mu$m are formed to the rear of the element board 203 by the trench structure etching by using an etching device using the dielectric junction plasma. At this moment, since the sacrificial layer 231 acts as an etching stop layer, the movable separation film 205 is not etched.

After that, the sacrificial layer 231 is eliminated by using a mixture of phosphate, acetic acid, and hydrochloric acid, and further, the adhesive 235 is eliminated, so that the second liquid flow passage 214 may be formed. Consequently, similarly to the first embodiment, the adhesive 235 is left only at the fixed part of the movable separation film 205 to the seat 204, and it is not left at the movable portion 205*a*.

As mentioned above, a liquid discharge head substrate having a flat movable separation film 205 supported by the seat 204 is obtained.

In the present embodiment, since the movable separation film 205 has a simple shape, the step of formation of the sacrificial layer 231 determining the shape of the movable separation film 205 is simplified, and as a result, it is possible to easily manufacture a liquid discharge head substrate integrated with the movable separation film 205. This is effective especially in the case where the material of the movable separation film 205 may easily be affected by heat and it is necessary to enlarge the distance to the heating element 202.

(Fourth Embodiment)

Figure 16:
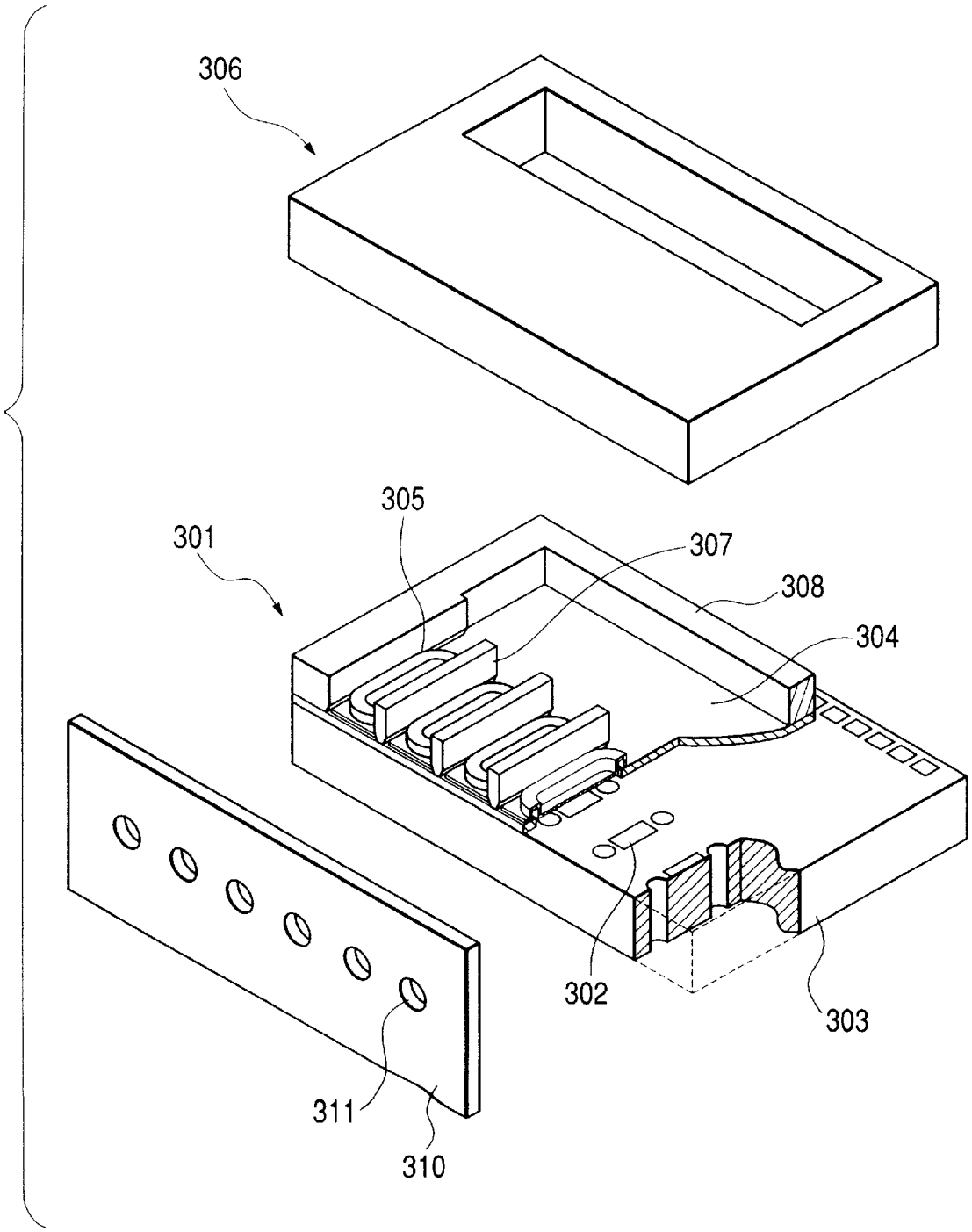
FIG. 16 is an exploded perspective illustration of a liquid discharge head which is the third embodiment of the present invention.

FIG. 16 is an exploded perspective illustration of a liquid discharge head which is a fourth embodiment of the present invention. Furthermore, FIG. 17 is a cross sectional view of the liquid discharge head shown in FIG. 16 which is cut along the liquid flow passage direction, and FIG. 18 is a cross sectional view along the arranging direction of the heating elements of the liquid discharge head shown in FIG. 16.

Figure 17:
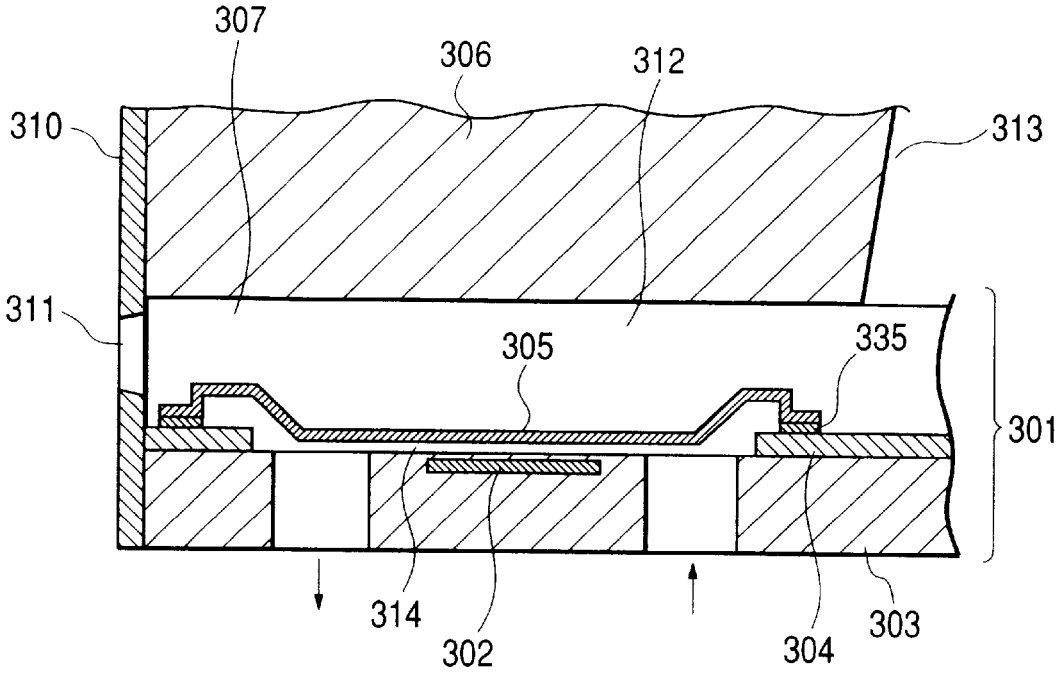
FIG. 17 is a cross sectional view along the liquid flow passage direction of the liquid discharge head shown in FIG. 16.
Figure 18:
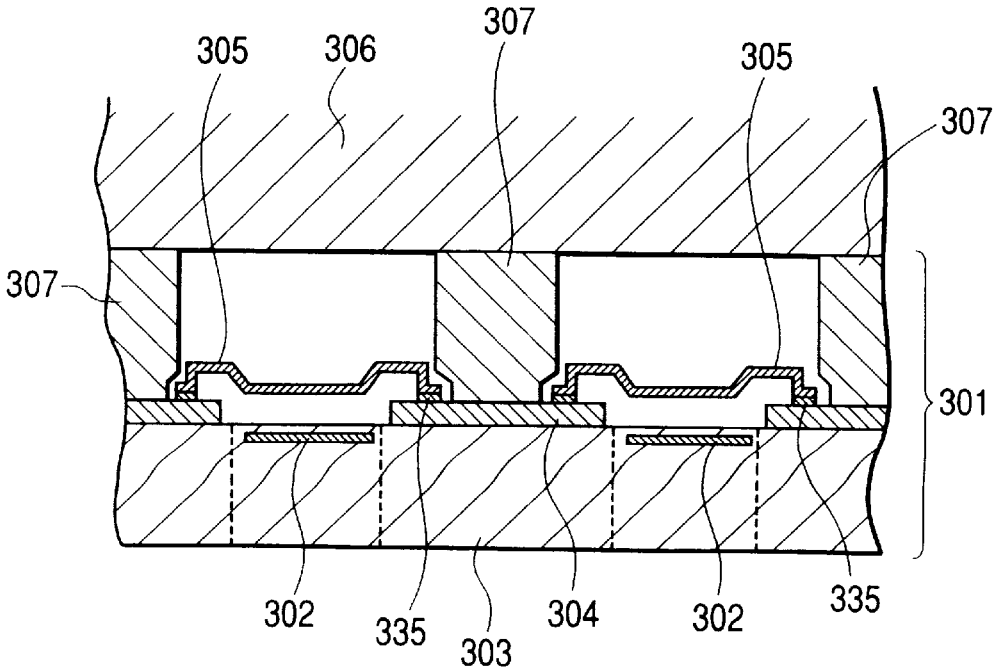
FIG. 18 is a cross sectional view along the arranging direction of the heating elements of the liquid discharge head shown in FIG. 16.
Figure 19F:
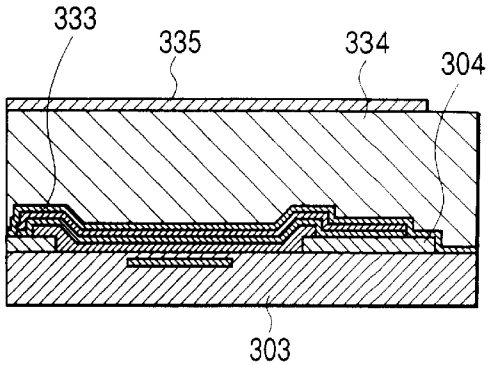
FIGS. 19A, 19B, 19C, 19D, 19E, 19F, 19G and 19H are cross sectional views along the liquid flow passage direction showing the manufacturing step of a liquid discharge head substrate configuring the liquid discharge head of a fourth embodiment of the present invention.
Figure 19G:
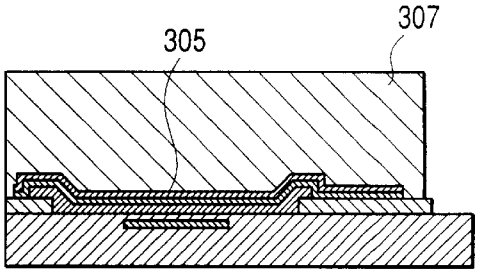
Figure 19H:
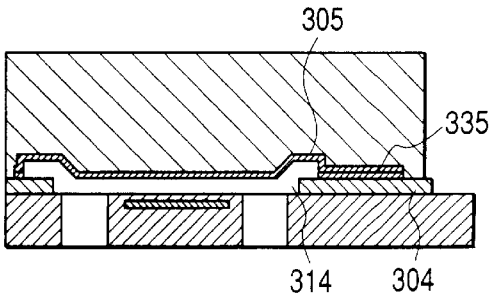
Figure 19A:
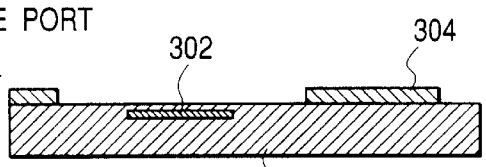
Figure 19B:
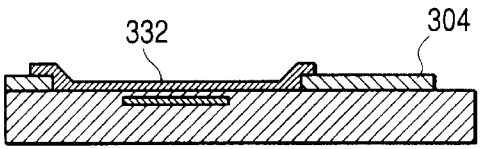
Figure 19C:
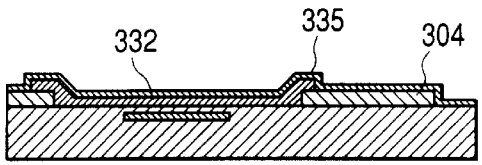
Figure 19D:
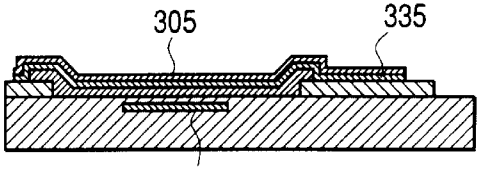
Figure 19E:
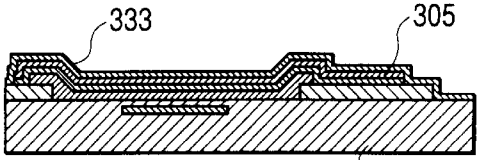
Figure 20A:
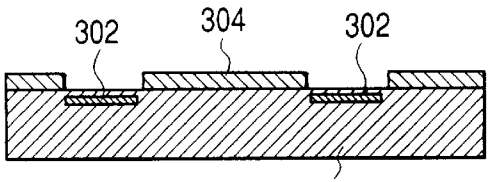
FIGS. 20A, 20B, 20C, 20D, 20E, 20F, 20G and 20H are cross sectional views along the arranging direction of the heating elements showing the manufacturing step of a liquid discharge head substrate configuring the liquid discharge head of the fourth embodiment of the present invention.
Figure 20B:
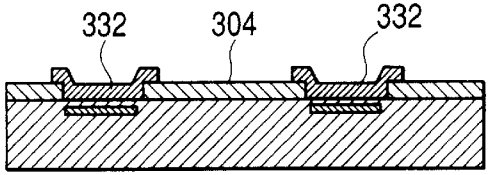
Figure 20C:
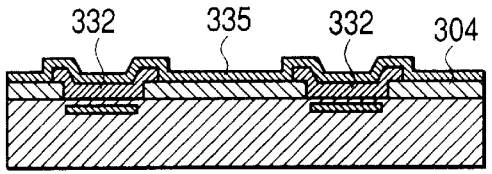
Figure 20D:
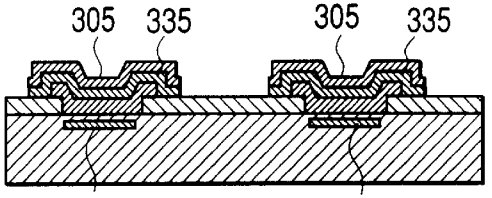
Figure 20E:
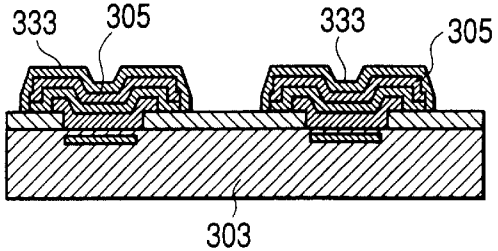
Figure 20F:
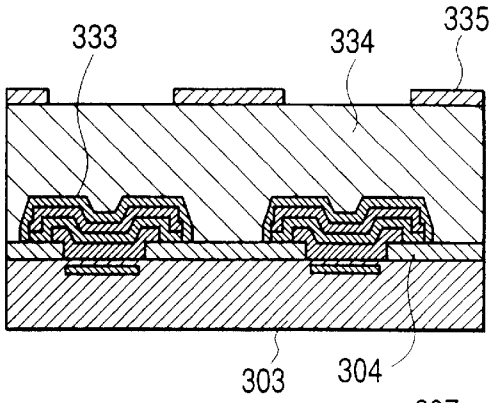
Figure 20G:
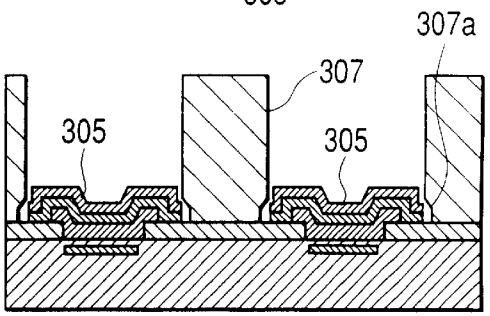
Figure 20H:
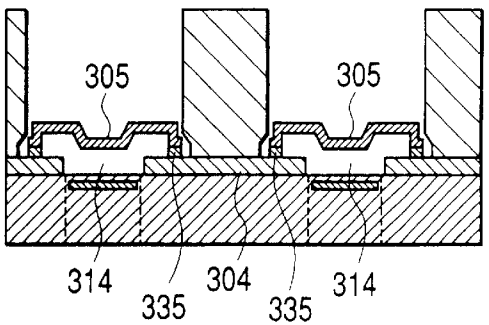

As shown in FIGS. 16 to 18, similarly to the first embodiment, the liquid discharge head of the present embodiment also comprises a liquid discharge head substrate 301, a top board 306, and an orifice plate 310.

The liquid discharge head substrate 301 has an element board 303 where a plurality of heating elements 302 for respectively giving energy for creating bubbles to the liquid are provided, and to the seat 304 provided on the top thereof through the adhesive 335, a plurality of mutually independent individual separation film 305 corresponding to the respective heating elements 302 are supported opposite to the respective heating elements with a clearance, respectively. Consequently, to the liquid discharge head substrate 301, second liquid flow passages 314 corresponding to the respective heating elements 302 are formed. The shape of the part except for the joining portion to the seat 304 of the individual separation film 305 is similar to that of the first embodiment. Furthermore, in the element board 303, similarly to the first embodiment, a supply hole for supplying bubbling liquid to the second liquid flow passage 314 and a discharge hole for discharging the bubbling liquid supplied to the second liquid flow passage 314 from the second liquid flow passage 314 are bubbled.

Moreover, in the liquid discharge head substrate 301 of the present embodiment, on the top of the seat 304, flow passage walls 307 configuring a plurality of first liquid flow passages 312 corresponding to the second liquid flow passages 314 and a liquid chamber frame 308 configuring a common liquid chamber 313 are integrally formed.

Thus, since the flow passage walls 307 and the liquid chamber frame 308 are provided to the liquid discharge head substrate 301, the top board 306 is formed as a plate-like member in which the opening of the common liquid chamber 313 is formed.

As for other points such as a point of completely separating the first liquid flow passage 312 and the second liquid flow passage 314 by the individual separation film 305, a point of providing a plurality of outlets 311 connected to the respective first liquid flow passages 312 in the orifice plate, or a point of providing an external contact pad or the like to the element board 303, the present embodiment is similar to the first embodiment.

Next, the manufacturing method of a liquid discharge head of the present embodiment will be described.

First, the top board 306 can be made similarly to the first embodiment in such a way in which a silicon wafer is used and in this, the opening of the common liquid chamber 313 is formed by the etching treatment or the like. Furthermore, the orifice plate 310 can also be made in a way similar to that of the first embodiment.

Next, by referring to FIGS. 19A to 19H and FIGS. 20A to 20H, the manufacturing method of a liquid discharge head substrate will be described. By the way, in the following description, the steps a to h correspond to FIGS. 19A to 19H and FIGS. 20A to 20H.

Step a:

On the total of the top of the element board 303 where the heating element 302 and the external contact pad or the like are formed, a TiW film with a film thickness of about 5000 Å is formed by using the sputtering method as a protective layer for protecting the external contact pad. Next, on the TiW film, an SiN film with a thickness of about 10 $\mu$m is formed by the plasma CVD method, and the area except for the part to be the second liquid flow passage of this SiN film and the area where the external contact pad is formed is patterned by using a well known method such as the photo lithography, so that the seat 304 may be formed. By the way, the element board 303 is made from silicon, and the heating element 302 is formed by using the semiconductor manufacturing process to this silicon.

Step b:

On the top of the element board 303 where the seat 304 is formed, an Al film with a thickness of about 5 $\mu$m is formed by the sputtering method, and the area except for the part to be the second liquid flow passage and the peripheral portion thereof is patterned by using a well known method such as the photo lithography to form a sacrificial layer 332. Consequently, the sacrificial layer 332 is formed into a convex shape in the state where the peripheral portion thereof runs on the seat 304.

Step c:

On the top of the seat 304 and the sacrificial layer 332, a silane coupling agent to be an adhesive 335 is coated.

Step d:

On the top of the adhesive 335, a poly-para-xylylene film with a film thickness of about 2 $\mu$m is formed by the CVD method, and it is eliminated while leaving only the parts of the seat 304 on the sacrificial layer 332 and around that, and a plurality of mutually independent individual separation films 305 corresponding to the respective heating elements 302 are formed.

Step e:

On the element board 303 where the individual separation films 305 are formed, an Al film is formed by the sputtering method, and this is patterned by a well known method such as the photo lithography, and on the individual separation film 305, an etching stop layer 333 when forming a flow passage wall 307 to be described later is formed.

Step f:

On the element board 303 where the etching stop layer 333 is formed, an SiN film 334 with a film thickness of about 50 $\mu$m is formed by the $\mu$W-CVD method covering the etching stop layer 333 and the seat 304. After that, on the top of the SiN film 334, an Al film is formed by the sputtering method, and the part to be the liquid flow passage 308 and the part to be the liquid chamber frame 308 (refer to FIG. 16), are patterned by a well known method such as the photo lithography and a mask 335 is formed.

Step g:

By the laser absolution processing performed by radiating the excimer laser from the face where the mask 335 is formed to the SiN film 334, the part to be the first liquid flow passage of the SiN film 334 and the part to be the common liquid chamber are eliminated, and the flow passage wall 307 and the liquid chamber frame 308 are formed. At this moment, since the etching stop layer 333 exists at the bottom of the part where the SiN film 334 is eliminated, the individual separation film 305 is not eliminated. After that, the etching stop layer 333 and the mask 335 are eliminated by etching. The area 307*a* near the individual separation film 305 of the flow passage wall 307 formed like this has a shape of being scooped out by the above etching stop layer 333.

Step h:

After forming an $SiO_2$ film with a film thickness of about 1 $\mu$m on the rear of the element board 303 by thermal oxidation, the opening parts of the supply hole and the discharge hole are patterned by using a well known method such as the photo lithography. Then, the cylindrical supply hole and discharge hole with a diameter of 10 to 50 $\mu$m are formed to the rear of the element board 303 by the trench structure etching by using an etching device using the dielectric junction plasma. At this moment, since the sacrificial layer 332 acts as an etching stop layer, the individual separation film 305 is not etched.

After that, the sacrificial layer 332 is eliminated by using a mixture of phosphate, acetic acid, and hydrochloric acid, and further, the adhesive 335 is eliminated, so that the second liquid flow passage 314 may be formed. Consequently, similarly to the first embodiment, the adhesive 335 is left only at the fixed part of the individual separation film 305 to the seat 304, and it is not left at the movable portion.

As mentioned above, a liquid discharge head substrate 301 integrated with the flow passage walls 307 configuring the first liquid flow passage 312 is obtained. Thus, since the flow passage walls 307 configuring the first liquid flow passage 312 are integrally provided to the liquid discharge head substrate 301, the positional shift of the first liquid flow passage 312 relative to the second liquid flow passage 314 does not occur, and therefore, it is possible to provide a liquid discharge head which has a small dispersion in discharge properties and has a high reliability. Furthermore, it is possible for the top board 306 to have a simple plate-like shape, and as for the positioning of both when joining the top board 306 to the liquid discharge head substrate 301, an accuracy similar to that in the above first embodiment to third embodiment is not required. As a result of that, the step in regard to the positioning of the top board 306 and the liquid discharge head substrate 301 can be simplified.

As mentioned above, in the present embodiment, an example of forming an individual separation film 305 with a shape in which the part opposite to the heating element 302 is convex toward the second liquid flow passage 314 by using a sacrificial layer of a single layer has been shown, but it is also possible to enlarge the distance between the individual separation film 305 and the heating element 302 by forming the sacrificial layer separately by a plurality of times of operations like the second embodiment, or to let the movable separation film be a flat movable separation film like the third embodiment. In these cases, it is possible to obtain a liquid discharge head substrate integrate with the flow passage walls by performing the treatments of the step d and afterward described in the present embodiment, after the formation of the movable separation film.

Furthermore, in the above respective examples, an adhesive is used when fixing the movable separation film to the seat, but it is also possible to directly fix the movable separation film to the seat in the case when the adhering strength is not so required, or depending on the material of the seat.

(Other Embodiments)

As mentioned above, the embodiment of the main portion of the present invention has been described, and other embodiments capable of being applied to the respective embodiments of the present invention and other modified examples of the respective embodiments will be described below. By the way, in the following description, when there is no specific note, the application is possible in the above respective embodiments.

<Basic Principle of Discharge of a Liquid Discharge Head for Improving the Liquid Discharge Efficiency>

Next, in a liquid discharge head using a movable separation film like that of the present invention, the basic concept of discharge for making the discharge efficiency more excellent will be described by showing 2 examples.

FIGS. 21A to 21E through FIGS. 23A to 23C are figures for describing examples of the discharge method by the above liquid discharge head, and the outlet is arranged at the area of the end portion of the first liquid flow passage, and on the up stream side (in regard to the flowing direction of the discharge liquid in the first liquid flow passage) of the outlet, there is a displacement area of the movable separation film capable of being displaced which is displaced according to the growth of the generated bubbles.

Furthermore, the second liquid flow passage contains bubbling liquid or it is filled up with the bubbling liquid (preferably, supplementation is possible, and more preferably, movement of the bubbling liquid is possible), and it has a generating area of bubbles.

In the present example, this bubble generating area is also positioned corresponding to the up stream area from the outlet side in regard to the above flowing direction of the discharge liquid. In addition, the separation film is longer than the electrothermal energy converting substance forming the bubble generating area, and has a movable area, and it has an unillustrated fixed portion between the up stream side end portion of the electrothermal energy converting substance and the common liquid chamber of the first liquid flow passage in regard to the above flowing direction, preferably, at the up stream side end portion. Accordingly, the substantial movable range of the separation film can be understood by FIGS. 21A to 21E through FIGS. 23A to 23C.

The state of the movable separation film in these figures is a factor which represents the total obtained from elasticity of the movable separation film itself, thickness, or other additional structures.

[First Discharge Principle]

FIGS. 21A to 21E are cross sectional views in the flow passage direction for describing a first discharge method (in case of having the displacement step of the present invention from the mid-course of the discharge step) by using the liquid discharge head of the present invention.

In this example, as shown in FIGS. 21A to 21E, the first liquid flow passage 703 directly connected to the outlet 711 is filled up with the first liquid supplied from the common liquid chamber, and further, the second liquid flow passage 704 having the bubble generating area 707 is filled up with the forming liquid which is expanded by giving thermal energy by using the heating element 702. By the way, between the first liquid flow passage 703 and the second liquid flow passage 704, the movable separation film 705 for mutually separating the first liquid flow passage 703 and the second liquid flow passage 704 is provided. Furthermore, the movable separation film 705 and the orifice plate 709 are mutually adhered and fixed, and here, the liquids in the respective liquid flow passages are not mixed.

Here, the movable separation film 705 normally has no directivity when displaced by the bubbles generated in the bubble generating area 707, or rather, there are some cases where the displacement advances to the common liquid chamber side with a high degree of freedom of displacement.

In the present example of application, the attention is given to this movement of the movable separation film 705, and a means which directly or indirectly acts on the movable separation film 705 itself to regulate the direction of displacement is provided, and by that, the displacement (movement, expansion, or extension or the like) generated by bubbles of the movable separation film 705 has been turned in the outlet direction.

Figure 21A:
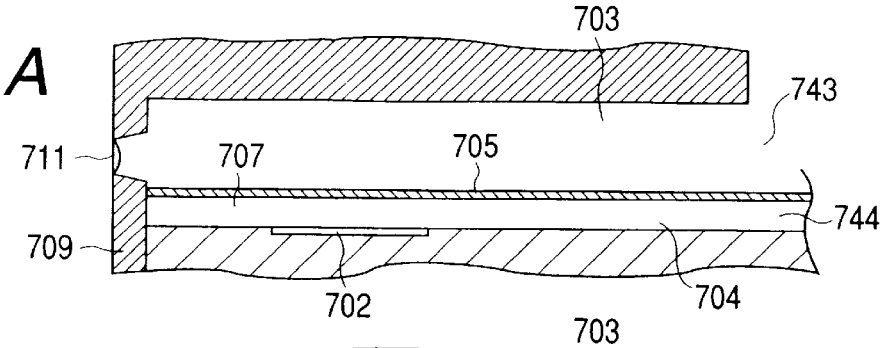
FIGS. 21A, 21B, 21C, 21D and 21E are cross sectional views in the flow passage direction for describing the basic discharge pattern for improving the discharge efficiency by the liquid discharge head of the present invention.

In the initial state shown in FIG. 21A, the liquid in the first liquid flow passage 703 is pulled in near the outlet 711 by the capillary force. By the way, in the present embodiment, the outlet 711 is positioned on the down stream side in regard to the liquid flowing direction of the first liquid flow passage 703 relative to the projection area to the first liquid flow passage 703 of the heating element 702.

Figure 21B:
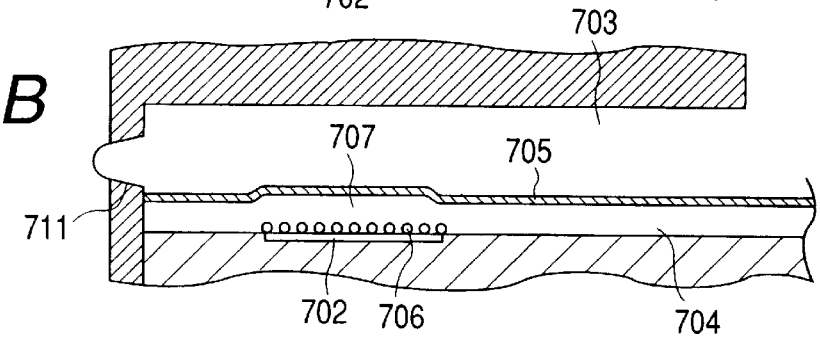

In this state, when thermal energy is given to the heating element 702 (in the present embodiment, a heating resistor with a shape of 40 $\mu$m×105 $\mu$m), the heating element 702 is rapidly heated, and the surface in contact with the second liquid in the bubble generating area 707 heats and expands the second liquid (FIG. 21B). The bubble 706 generated by this heating and expanding is an bubble based on such a film boiling phenomenon as described in U.S. Pat. No. 4,723,129, and it is generated at the same time onto the total area of the surface of the heating element accompanied with an extremely high pressure. The pressure generated at this moment is transmitted through the second liquid in the second liquid flow passage 704 as a pressure wave, and it acts on the movable separation film 705, and consequently, the movable separation film 705 is displaced, and the discharge of the first liquid in the first liquid flow passage 703 is started.

Figure 21C:
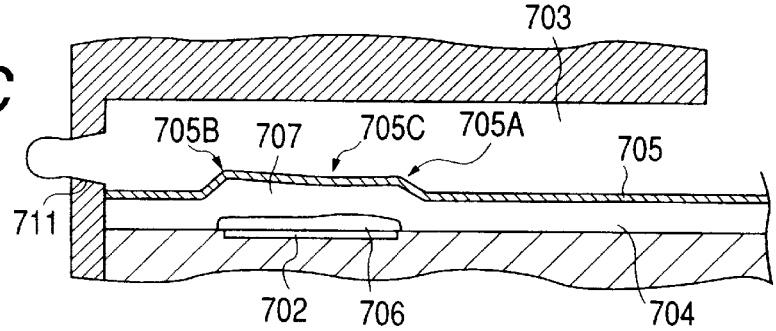

When the bubble 706 created on the total of the surface of the heating element 702 grows rapidly, it becomes filmy (FIG. 21C). The expansion of the bubble 706 by an extremely high pressure at the beginning of generation further displaces the movable separation film 705, and consequently, the discharge of the first liquid in the first liquid flow passage 703 from the outlet 701 progresses.

Figure 21D:
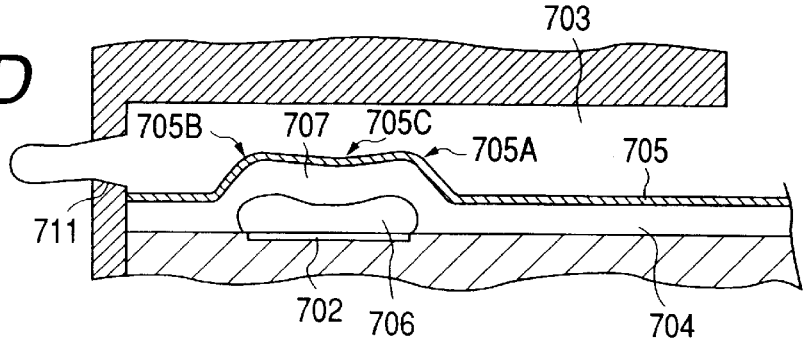

After that, when the bubble 706 further grows, the displacement of the movable separation film 705 is increased (FIG. 21D). By the way, until the state shown in FIG. 21D, the movable separation film 705 continues to extend so that relative to the central portion 705C of the area opposite to the heating element 702 of the movable separation film 705, the displacement of the up stream side portion 705A thereof and the displacement of the down stream side portion 705B thereof may be approximately equal.

Figure 21E:
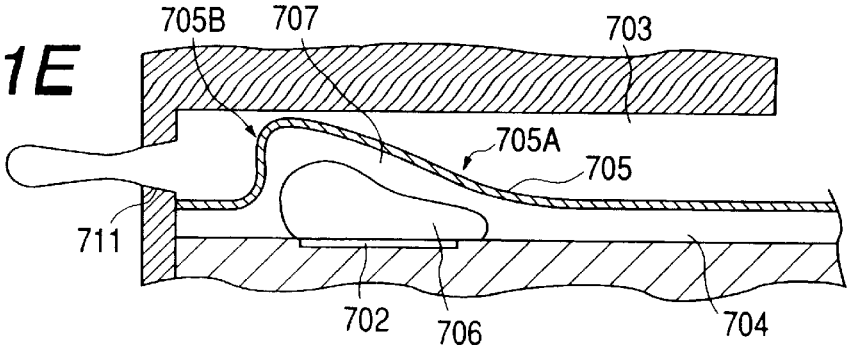

After that, when the bubble 706 further grows, in the bubble 706 and the movable separation film 705 continuing displacement, the down stream side portion 705B are displaced in the outlet direction relatively more largely than the up stream side portion 705A, respectively, and consequently, the first liquid in the first liquid flow passage 703 is directly moved in the outlet 701 direction (FIG. 21E).

Thus, since the there is a step in which the movable separation film 705 is displaced in the discharge direction on the down stream side to directly move the liquid in the outlet direction, the discharge efficiency is further improved. Furthermore, the movement of the liquid to the up stream side is relatively decreased, and it effectively acts on the refill of the liquid (supplementation from the up stream side) in the nozzle, especially in the displacement area of the movable separation film 705.

Furthermore, as shown in FIG. 21D and FIG. 21E, in the case when the movable separation film 705 itself is also displaced in the outlet direction like the change from FIG. 21D to FIG. 21E, the above discharge efficiency and refill efficiency can further be improved, and in the meantime, the transportation and movement in the outlet direction of the first liquid of the projection area of the heating element 702 in the first liquid flow passage 703 is caused, so that the improvement of the amount of discharge can be attained.

[Second Discharge Principle]

FIGS. 22A to 22E are cross sectional views in the flow passage direction for describing a second discharge method (example of having the displacement step of the present invention from the initial stage) by using the liquid discharge head of the present invention. Since the present example also has a constitution basically similar to that in the above first discharge principle, the description will be given by using the same referenced numerals.

Figure 22A:
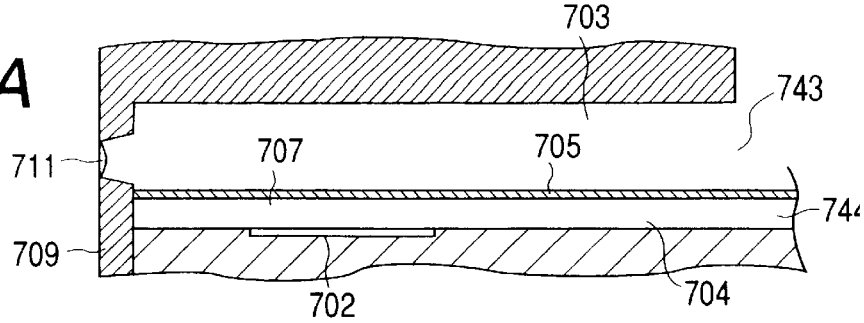
FIGS. 22A, 22B, 22C, 22D and 22E are cross sectional views in the flow passage direction for describing the basic discharge pattern for improving the discharge efficiency by the liquid discharge head of the present invention.

In the initial state shown in FIG. 22A, similarly to FIG. 21A, the liquid in the first liquid flow passage 713 is pulled in near the outlet 711 by the capillary force. By the way, in the present embodiment, the outlet 711 is positioned on the down stream side relative to the projection area to the first liquid flow passage 713 of the heating element 712.

Figure 22B:
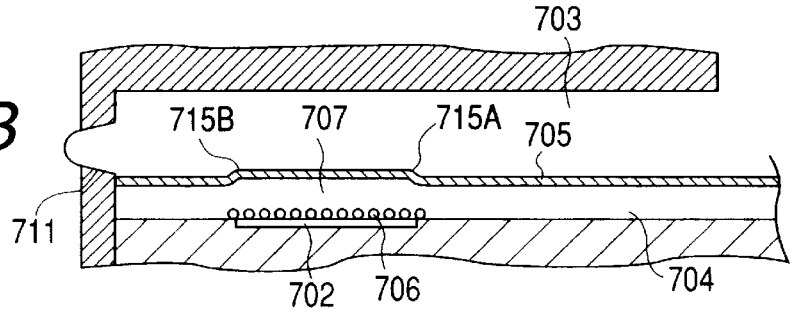

In this state, when thermal energy is given to the heating element 702, the heating element 702 is rapidly heated, and the surface in contact with the second liquid of the bubble generating area 707 heats and expands the second liquid (FIG. 22B). The pressure generated at this moment is transmitted through the second liquid in the second liquid flow passage 704 as a pressure wave, and it acts on the movable separation film 705, and consequently, the movable separation film 705 is displaced, and the discharge of the first liquid in the first liquid flow passage 703 is started.

Figure 22C:
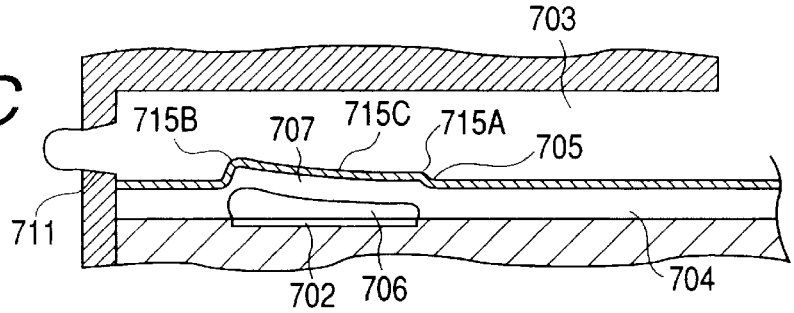

When the bubble 706 created on the total of the surface of the heating element 702 grows rapidly, it becomes filmy (FIG. 22C). The expansion of the bubble 706 by an extremely high pressure at the beginning of generation further displaces the movable separation film 705, and consequently, the discharge of the first liquid in the first liquid flow passage 703 from the outlet 711 progresses. At this moment, (as shown in FIG. 22C, in the movable separation film 705, the down stream side portion 715B is displaced relatively more largely than the up stream side portion 715A, in the movable area from the initial stage. Consequently, the first liquid in the first liquid flow passage 703 can efficiently be moved to the outlet 711 from the beginning.

Figure 22D:
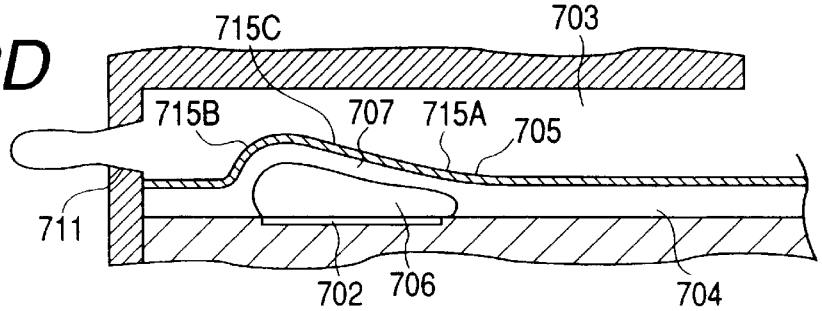

After that, when the bubble 706 further grows, the displacement of the movable separation film 705 and the growth of bubbles are promoted relative to the state of FIG. 22C, and therefore, accompanied with that, the displacement of the movable separation film 705 is also increased (FIG. 22D). Especially, since the down stream side portion 715B of the movable area is displaced in the outlet direction more largely than the up stream side portion 715A and the central portion 715C, the first liquid in the first liquid flow passage 703 moves while directly accelerating in the outlet direction, and in the meantime, since the displacement of the up stream side portion 715A is small in all steps, the movement of the liquid in the up stream direction is decreased.

Accordingly, the discharge efficiency, especially the discharge speed can be improved, and in the meantime, it is also advantageous for the refill of liquid of the nozzle and the stabilization of volume of the discharge liquid drop.

Figure 22E:
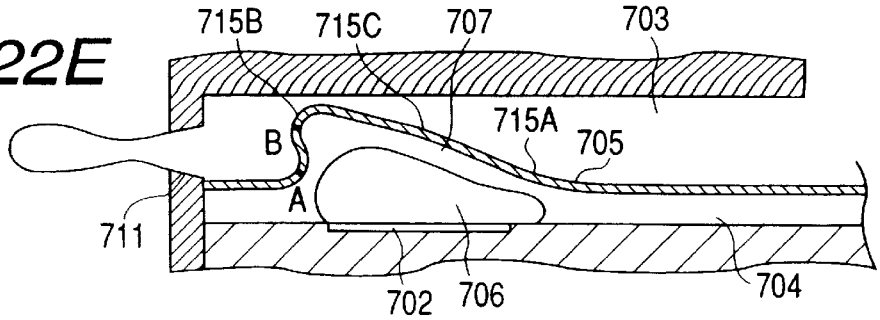

After that, when the bubble 706 further grows, the down stream side portion 715B of the movable separation film 705 and the central portion 715C is further displaced and extended in the outlet direction, and the above effect, that is, the improvement of the discharge efficiency and the discharge speed can be attained (FIG. 22E). Especially, in the shape of the movable separation film 705 in this case, not only the size shown by the sectional form but also the displacement and extension in the width direction of the liquid flow passage is increased, and consequently, the operative area of moving the first liquid in the first liquid flow passage 703 in the outlet direction is increased, and the discharge efficiency is synergistically improved. Specially, the shape of displacement of the movable separation film 705 at this moment is called a nose shape since it resembles the shape of a human nose. By the way, this nose shape includes the shape of [S] in which as shown in FIG. 22E, the point B positioned on the up stream side in the initial state is positioned on the down stream side from the point A positioned on the down stream side in the initial state, or the shape in which as shown in FIG. 21C, these points A, B exist at the same position.

[Example of the Mode of the Displacement of a Movable Separation Film]

Figure 23A:
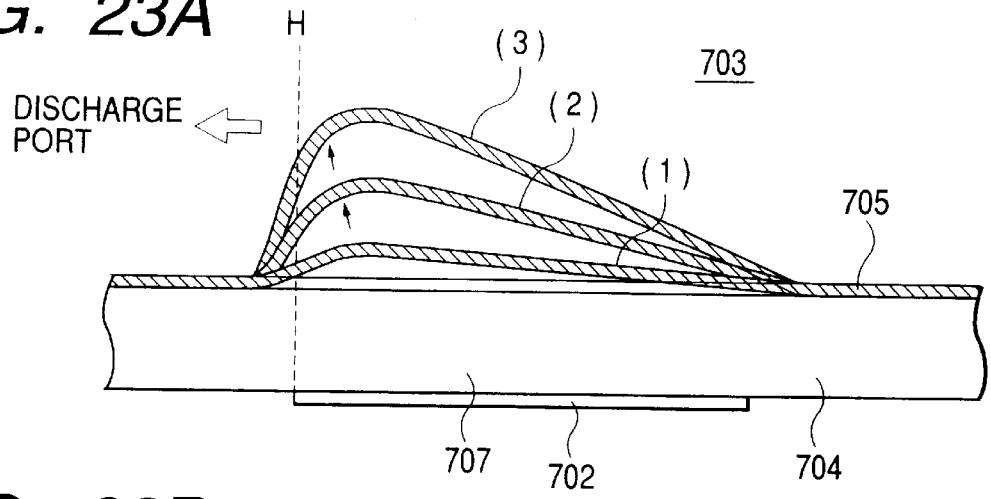
FIGS. 23A, 23B and 23C are cross sectional views in the flow passage direction for describing the displacement step of the movable separation film for improving the discharge efficiency in the liquid discharge head of the present invention.
Figure 23B:
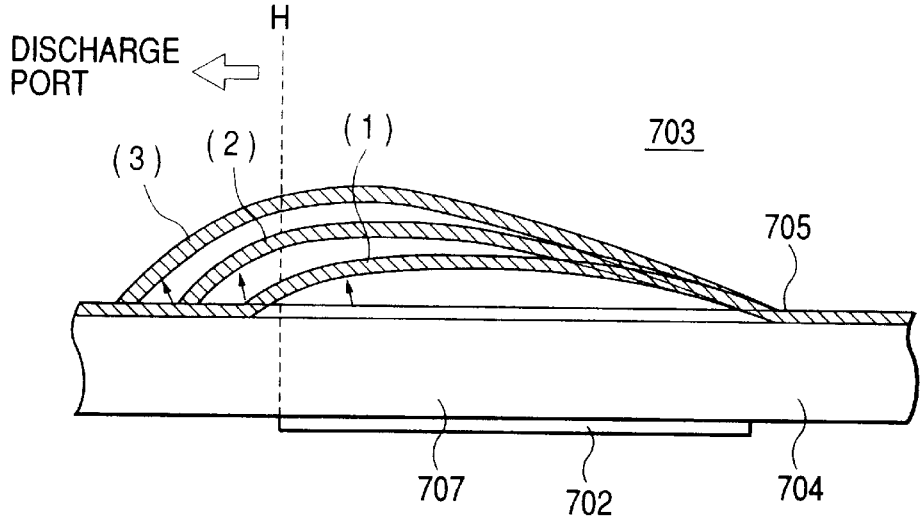
Figure 23C:
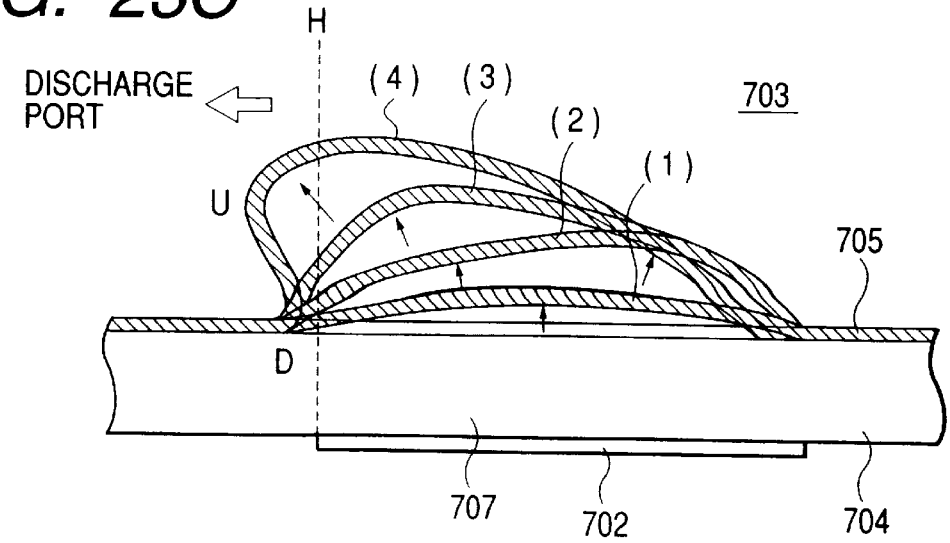

FIGS. 23A to 23C are cross sectional views in the flow passage direction for describing the displacement step of the movable separation film during the discharge action by the liquid discharge head of the present invention.

Here, especially, since the description is performed while aiming at the movable range of the movable separation film and the change of the displacement, the illustrations of bubbles, the first liquid flow passage, and the outlet are omitted, but in each figure, as a basic configuration, the area near the projection area of the heating element 702 in the second liquid flow passage 704 is the bubble generating area 707, and the second liquid flow passage 704 and the first liquid flow passage 703 are substantially separated by the movable separation film 705 at all times, that is, through the displacement term from the beginning. Furthermore, the outlet is provided on the down stream side letting the down stream side end portion (line H in the figure) of the heating element 702 be the boundary, and the first liquid supply portion is provided on the up stream side. By the way, hereafter, "up stream side" and "down stream side" have the meanings in regard to the liquid flowing direction in the flow passage when seen from the central portion of the movable range of the movable separation film.

In the step shown in FIG. 23A, the movable separation film 705 is displaced in the order of (1), (2), and (3) in the figure from the initial state, and it has a step in which the down stream side is displaced more largely than the up stream side from the beginning, and especially, since there is an action of creating a movement for the displacement on the down stream side to push out the first liquid in the first liquid flow passage 703 in the outlet direction while raising the discharge efficiency, the improvement of the discharge speed can be attained. By the way, in FIG. 23A, the above movable range is substantially constant.

In the step shown in FIG. 23B, the movable range of the movable separation film 705 is moved or expanded to the outlet side, as the movable separation film 705 is displaced in the order of (1), (2), and (3) in the figure. In this mode, in the above movable range, the up stream side thereof is fixed. Here, while the down stream side of the movable separation film 705 is displaced more largely than the up stream side, the growth itself of the bubble can also be attained in the outlet direction, and therefore, the discharge efficiency can further be raised.

In the step shown in FIG. 23C, in the movable separation film 705, the up stream side and the down stream side are equally displaced or the up stream side is displaced a little largely from the initial state (1) to the state shown by (2) in the figure, but when the bubble further grows as shown by (3) to (4) in the figure, the down stream side is displaced more largely than the up stream side. Consequently, the first liquid at the top of the movable area can also be moved in the outlet direction, and the amount of discharge can be increased while the discharge efficiency can be improved.

Furthermore, in the step shown by (4) in FIG. 23C, since a certain point U of the movable separation film 705 is displaced to the outlet side from a point D positioned on the down stream side thereof in the initial state, the discharge efficiency is further improved by this part expanded and projected to the outlet side. By the way, this shape is called a nose shape as mentioned above.

The liquid discharge methods having such steps as described above are included in the present invention, but each step shown in FIGS. 23A to 23C is not always independent, but a step having the respective components is also included in the present invention. Furthermore, the step having a nose shape can be introduced not only into the step shown in FIG. 23C but also into the steps shown in FIG. 23A and FIG. 23B. Furthermore, the thickness of the movable separation film in the figure has no special meaning in size.

<Liquid Discharge Head Cartridge and Liquid Discharge Recording Apparatus>

Next, the description of a liquid discharge head cartridge where a liquid discharge head according to the above embodiment is mounted and a liquid discharge recording apparatus will be given by referring to FIG. 24 and FIG. 25.

Figure 24:
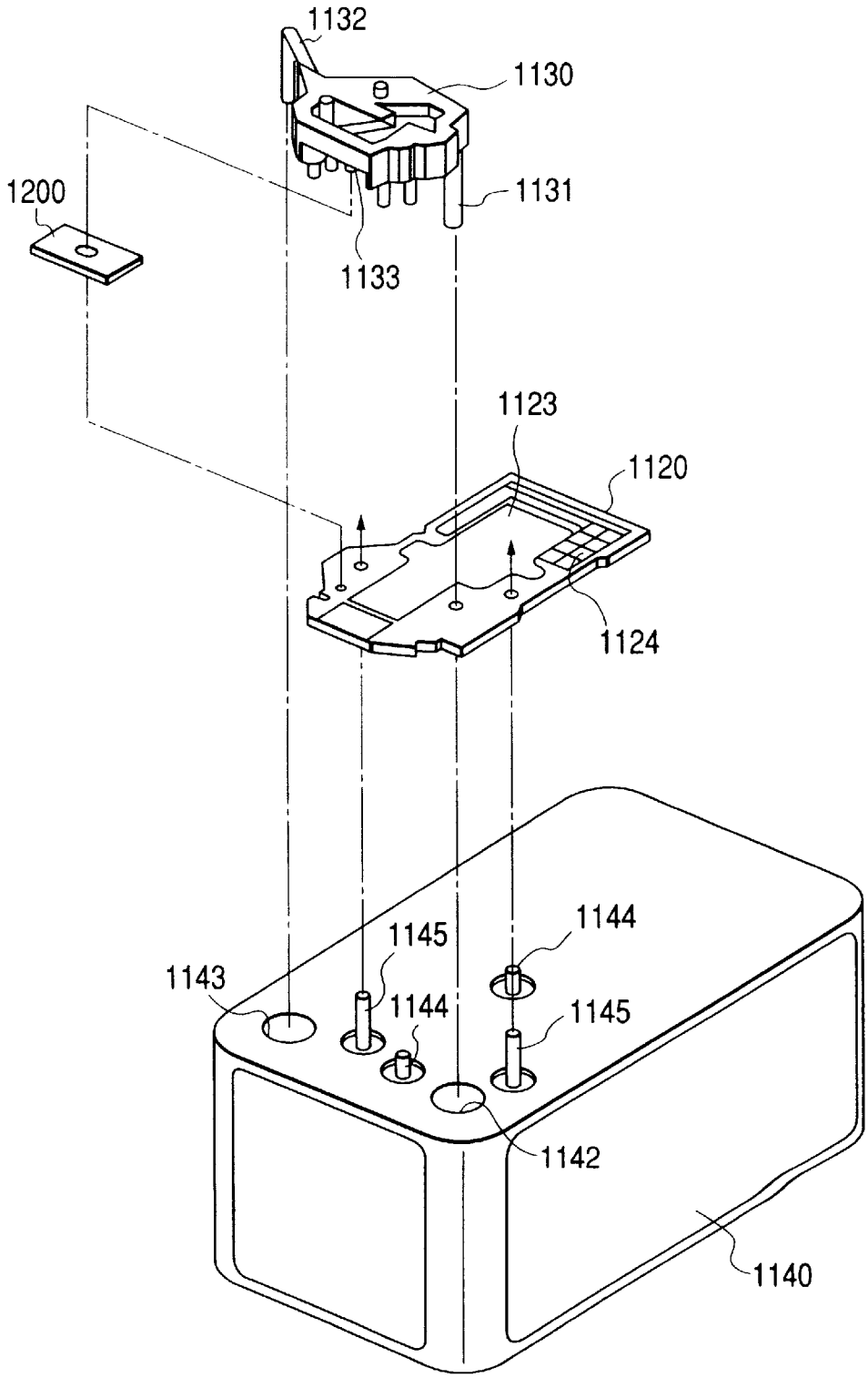
FIG. 24 is an exploded perspective illustration of a liquid discharge head cartridge to which the present invention can be applied.

FIG. 24 is a schematic sectional perspective illustration of a liquid discharge head cartridge including the above liquid discharge head, and the liquid discharge head cartridge roughly and mainly comprises a liquid discharge head portion and a liquid vessel 1140.

The liquid discharge head portion comprises the above liquid discharge head 1200, liquid supply member 1130, aluminum base plate (support) 1120 or the like. The support 1120 is a substance for supporting the liquid discharge head 1200 or the like, and on this support 1120, a printed wiring board 1123 connected to the liquid discharge head 1200 for supplying an electric signal and a contact pad 1124 connected to the device side for performing the exchange of electric signals with the device side are further arranged.

The liquid vessel 1140 contains liquid supplied to the liquid discharge head 1200. On the outside of the liquid vessel 1140, a positioning portion 1144 for arranging a connecting member performing the connection between the liquid discharge head portion and the liquid vessel 1140, and a fixing shaft 1145 for fixing the connecting member are provided. The liquid is supplied from liquid supply routes 1142, 1143 of the liquid vessel 1140 through a supply route of the connecting member to liquid supply routes 1131, 1132 of the liquid supply member 1130, and it is supplied through liquid supply routes 1133, 1129, 1153*c* of the respective members to a common liquid chamber of the liquid discharge head 1200. Here, the supply of liquid from the liquid vessel 1140 to the liquid supply member 1130 is performed by being divided into 2 routes, but the dividing is not always necessary.

By the way, it is also possible to use this liquid vessel 1140 by refilling it with liquid after the consumption of liquid. For this, it is preferable to provide a liquid inlet in the liquid vessel 1140. Furthermore, it is also possible that the liquid discharge head portion and the liquid vessel 1140 are integrated, and it is also possible that they are dividable.

Figure 25:
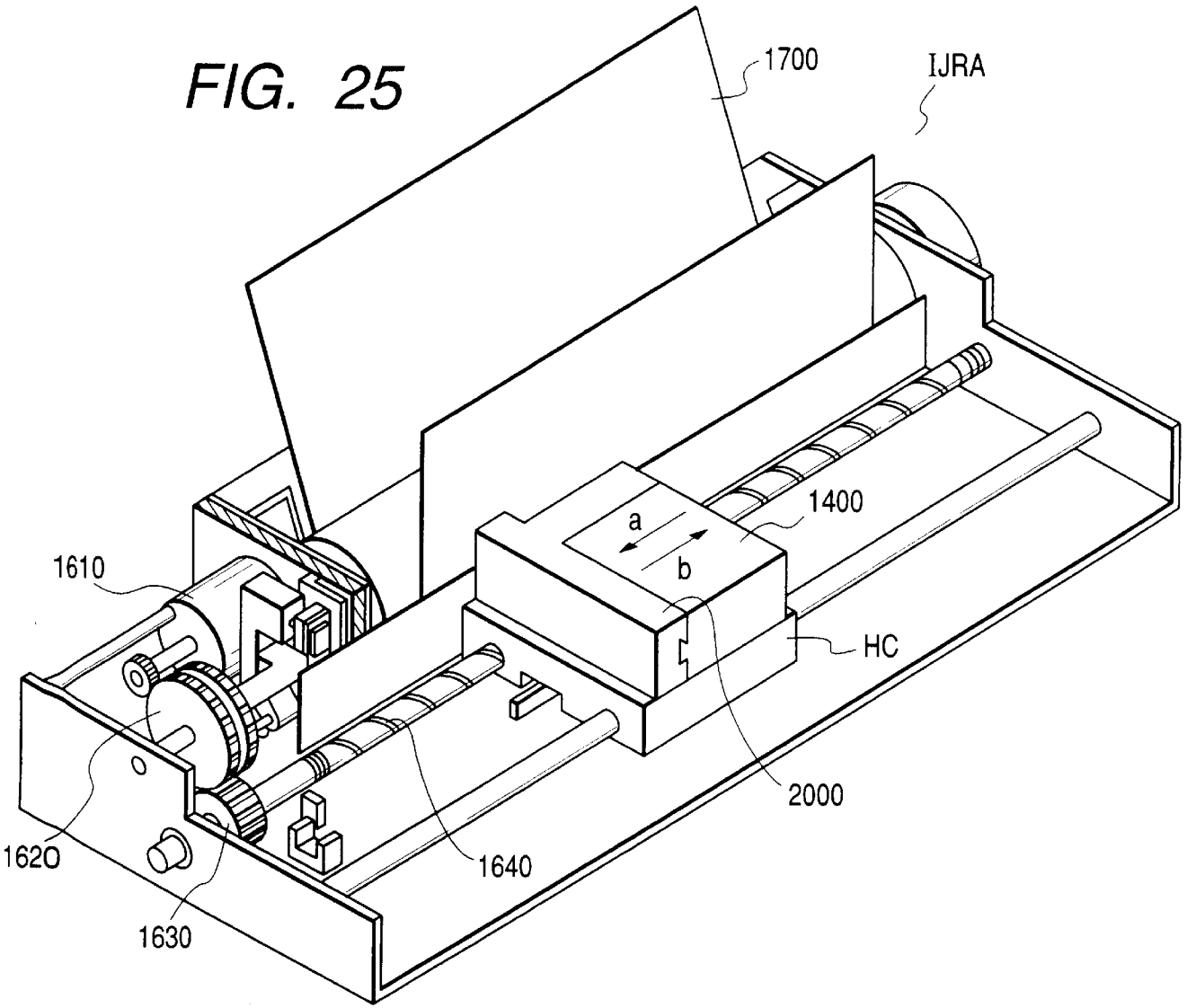
FIG. 25 is a schematic illustration of a liquid discharge device to which the present invention can be applied.

FIG. 25 shows a rough configuration of a liquid discharge device where the above liquid discharge head is mounted. In the present embodiment, specifically, the description will be given by using the ink discharge recording apparatus IJRA using ink as a discharge liquid. Onto a carriage HC of the liquid discharge device, a head cartridge is mounted, to and from which the liquid vessel 1400 containing ink and the liquid discharge head portion 2000 can be installed and removed, and it moves back and forth in the width direction (direction shown by the arrows a, b) of a recorded medium 1700 such as recording paper transferred by a recorded medium transfer means. By the way, the liquid vessel and the liquid discharge head portion are configured to be mutually dividable.

In FIG. 25, when a drive signal is supplied from unillustrated drive signal supply means to liquid discharge means on the carriage HC, recording liquid is discharged from the liquid discharge head portion 2000 to the recorded medium 1700 according to this signal.

Furthermore, the liquid discharge device of the present example comprises a motor 1610 as a drive power source for driving the recorded medium transfer means and the carriage HC, gears 1620, 1630 for transmitting the motive power from the drive power source to the carriage HC, and a carriage shaft 1640 or the like. A recorded matter with a preferable image could be obtained by discharging liquid to various recorded media by using this recording apparatus.

(Preferable Technical View Point of Separation Film)

The present invention has found a more preferable condition for the above separation film, on the basis of the fact that the separation film of poly-para-xylylene (hereafter, referred to as PPX) used in the above first embodiment to fourth embodiment can also be applied to another liquid discharge head having a separation film other than that of the present invention.

Especially, when examining the physical properties of the above PPX, the following new practical knowledge (especially, decomposition temperature of an organic film) has been found.

By the way, in the following description, "surface layer of a heating element" is used to express "surface of a film of the top layer" in the case where a protective film for protecting the heating element and a cavitation resistant film are formed on the surface of the element board, and "surface of the heating element" in the case where no protection film like this is provided. That is, this word is used to show the part where the bubble is created by the heating of the heating element.

<Relation between Movable Separation Film and Heating Element Surface Layer Temperature>

In case of normal ink of the dyestuff family, generally, in the film boiling for forming bubbles, the bubbling start temperature is a temperature which can be obtained by a sudden temperature rise (on the surface layer of the heating element, for example, 300° C. or more, and practically, about 350° C.), and in some cases, the maximum temperature in bubbling reaches about 600° C. on the surface layer of the heating element. This temperature occurs for a time of an order of μseconds, and it does not continue for a long time. Then, when the bubbles are debubbled, the temperature on the surface layer of the heating element becomes about 180° C. (practically, about 200° C.).

Under such a condition, in case of using a separation film, in some cases, a part where the properties of a separation film was suddenly lowered occurred suddenly, or a broken part occurred. After pursuing this cause, a preferable condition required for a separation film has been found.

That is, in case of forming a movable separation film by piling up organic materials by a method of the chemical vapor phase reaction or plasma polymerization reaction, it is sufficient that in the temperature of the movable separation film, the heat decomposition temperature in these reaction steps is higher than the conditional temperature at which the movable separation film is exposed. Furthermore, even if the temperature of the movable separation film becomes temporarily higher than the melting point (lower than the heat decomposition temperature) of the movable separation film for a short time of an order of tens μseconds to several minutes, it is unnecessary to be considered.

Therefore, in some cases, the relation given by the separation film and the temperature on the surface layer of the above heating element at the time of discharge is as follows. Effective conditions in those cases will be given below.

(1) Case of a single discharge action

First, a case of discharging 1 drop of liquid drop from the initial state (or a continuous discharge action in which the time interval to the next discharge action is long (for example, tens milliseconds to several seconds or more)) will be considered.

At this moment, for the time from bubbling start to bubble growth, usually, the movable separation film is fixed by the second flow passage wall, and it is apart from the surface layer of the heating element through the liquid (bubbling liquid) by a specified distance, and therefore, it is unnecessary to consider the influence directly given to the movable separation film by the temperature of the surface layer of the heating element.

However, when the liquid is discharged from the outlet and the bubble is debubbled, it is supposed that the movable separation film approaches or comes into contact with the surface layer of the heating element by cavitation. In this case, after the debubbling, the movable separation film intends to return to the position of the initial state at once by the refill of bubbling liquid or the like, and therefore, it is sufficient to consider an instantaneous heat resistance.

Accordingly, when the heat decomposition temperature of the material used for the separation film is higher than the surface layer temperature of the heating element at the time of debubbling, the movable separation film is not decomposed even if the movable separation film comes into contact with the surface layer of the heating element.

(2) Case of a continuous discharge action

Next, a case of continuously performing the discharge action at a time interval of tens to hundreds μseconds will be considered.

When the interval of the discharge action is short like this, it is necessary to consider the possibility that the movable separation film adheres to the surface layer of the heating element at the time of bubbling start rather than at the time of debubbling, if the refill of the bubbling liquid is performed so that the bubbling liquid of a desired amount may exist in the bubble generation area when required.

In this case, when a very small bubble is generated by the heating of the heating element, the bubble exists between the movable separation film and the surface layer of the heating element, and therefore, while the bubble continues to grow, it does not occur that the distance between the surface layer of the heating element and the separation film becomes shorter than that at the bubbling start time.

Accordingly, it is sufficient to consider the surface layer temperature of the heating element at the bubbling start time, and further, the time for the removable separation film to be in contact with the surface layer of the heating element is extremely short as mentioned above, and therefore, when the heat decomposition temperature of the material used for the movable separation film is higher than the surface layer temperature of the heating element at the bubbling start time, similarly to the above deforming time, the movable separation film is not decomposed even if the movable separation film comes into contact with the surface layer of the heating element.

Furthermore, under the situation where the continuous discharge action is performed for a long term of, for example, several minutes to tens minutes, there are some cases where it is necessary to consider the maximum temperature of the surface layer of the heating element not only at the bubbling start time but also during the bubbling. In this case, it is preferable to emphasize the fact that the movable separation film is not decomposed by heat even in the case where the heat radiation of the liquid discharge head is not sufficiently performed by the continuous discharge action.

That is, since the temperature of the liquid discharge head does not exceed the above maximum temperature of the surface layer of the heating element during the bubbling, there is no possibility that the movable separation film is decomposed by heat when the heat decomposition temperature of the material used for the movable separation film is higher than the maximum temperature of the surface layer of the heating element.

(3) Case of an abnormal action

Next, a case of occurrence of an abnormal action where the bubbling liquid is insufficient (or does not exist) in the bubble generating area of the second liquid flow passage because of the insufficiency of the refill of the bubbling liquid or the like will be examined.

In such a case, the possibility that the movable separation film provided to the corresponding nozzle adheres to the surface layer of the heating element is increased, and in the meantime, a phenomenon where the liquid is not discharged from the corresponding outlet occurs.

In a normal liquid discharge head or a liquid discharge recording apparatus to which the head is mounted, a detecting portion for detecting such a state of no discharge is provided, and it is possible to return to the normal state by restoring the bubbling liquid flow passage (and the discharge liquid flow passage if necessary) by a well known restoring means or the like on the basis of the detected results.

In case of having such a restoring means, the condition required for the film is different depending on when the restoring action is performed after the occurrence of the abnormality or how much the amount of the bubbling liquid existing in the bubble generating area is.

For example, in the case where the above restoring action is performed in a time of a degree of tens seconds to several minutes after the occurrence of the abnormality, it is unnecessary to consider the melting point of the movable separation film, and it is sufficient to consider the heat decomposition temperature.

Furthermore, in the case where at the time of debubbling, the movable separation film is adhered to the surface layer of the heating element and the refill of the bubbling liquid is not performed and it is left as it is, or in the case where at the time of the above continuous discharge action, the refill of the bubbling liquid is insufficient and at the time of deforming, a state for the movable separation film to often come into contact with the surface layer of the heating element continues for a long time of tens minutes or more, it is preferable to emphasize the fact that the melting point of the movable separation film is higher than the surface layer temperature of the heating element at the time of deforming.

On the other hand, in the case where a state of almost no bubbling liquid on the bubble generating area continues for a long term of tens minutes or more, it is preferable to emphasize the fact that the melting point of the movable separation film is higher than the surface layer temperature of the heating element at the time of bubbling start.

<Exemplification of PPX>

The present inventor and others paid attention to PPX as a material fulfilling the above relation between the movable separation film and the surface layer temperature of the heating element.

Here, the basic structure, manufacturing method and polymerizing method or the like of PPX's in the present invention are disclosed in the publications described in the above respective embodiments, and specifically, they are defined by the following chemical formulae (A) to (F) (provided that n is a whole number of 5000 or more), and they may be used independently or as a combination.

(A)

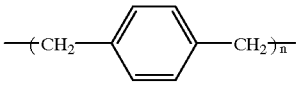

(B)

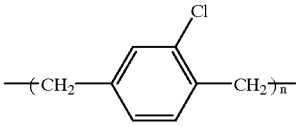

(C)

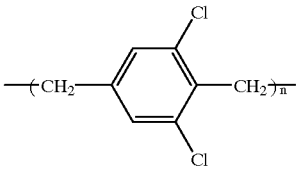

(D)

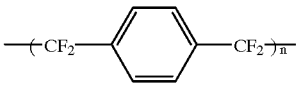

(E)

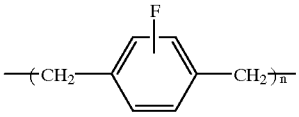

-continued (F)

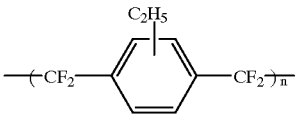

Furthermore, the following points can be cited as the common features of these PPX's.

PPX does not contain ionic impurities, and it is a crystalline polymer of a high purity with a cristallinity of about 60% and a molecular weight of about 500 thousands, and it is excellent in water repellency and gas barrier performance. Furthermore, it is insoluble to all organic solvents at a temperature of 150° C. or less, and it has resistance to almost all corrosive liquids such as acids or alkalis. Furthermore, it shows an excellent stability against the repeated displacement. Furthermore, the precise control of the thickness when forming a film is easy, and it is possible to form a film having a shape exactly fitted to the shape of the attached substance, and in the meantime, it is possible to form a film with no pin hole depending on the attached substance even if the thickness is 2 $\mu$m. Furthermore, since a mechanical stress because of the effect stress or a thermal stress because of the thermal strain is not applied to the attached substance, it is excellent in adhesive stability to the attached substance after the film formation.

Therefore, as for the materials shown in formulae (A), (B) and (C), a head substrate integrated with the movable separation film was prepared by a manufacturing method shown in FIGS. 5A to 5E of the above first embodiment (provided that the film formation itself of the movable separation film was performed by the vapor polymerizing method, and as for the sacrificial layer, a proper material (for example, Al) which could attain a selection ratio with the movable separation film and the element board by a solvent of etching rate was selected), and after being joined to the top board integrated with the liquid flow passage shown in FIG. 4 by using adhesives or the like, an orifice plate was joined, and consequently, a liquid discharge head was prepared.

The results of the examination of the respective physical properties and basic characteristics, and qualities related to the vaporization at the time of film formation were shown in the following table 1.

TABLE 1

| Sample | A (composition is shown in formula (A)) | B (composition is shown in formula (B)) | C (composition is shown in formula (C)) |
|---|---|---|---|
| Melting point | 405° C. | 280° C. | 350° C. |
| Qualities | colorless and transparent excellent in permeability to a small clearance coating film is soft excellent in electrical characteristics constant dielectric characteristics shown in each frequency area | colorless and transparent excellent in penetration prevention of water vapor and gas formation of thin film with no pin hole is possible excellent in electrical characteristics | colorless and transparent coating film is slightly hard excellent in chemical resistance excellent in heat resistance |

TABLE 1-continued

| Sample | A (composition is shown in formula (A)) | B (composition is shown in formula (B)) | C (composition is shown in formula (C)) |
|---|---|---|---|
| | high insulating power | | |
| Vapor deposition | a little slow | good | not so good |

The heat decomposition temperature of these samples is 680° C. as one example, and it is about 700° C. in each sample, and the heat decomposition temperature is higher than any one of the surface layer temperature of the heating element and at the time of bubble deforming and the maximum reachable temperature of the surface layer of the heating element, at the time of film boiling start by the above heating element.

Furthermore, the melting point of any one of the samples is higher than the surface layer temperature of the heating element at the time of bubble debubbling. By the way, as for the comparison between the melting point of each sample and the surface layer temperature of the heating element at the time of film boiling start by the heating element, the melting points of the samples A, C are higher than the surface layer temperature of the heating element at the time of film boiling start, respectively.

In any one of the liquid discharge heads using the above samples as a movable separation film, it was confirmed that the number of times of liquid drop discharge in each nozzle was greatly increased when compared with that in a liquid discharge head using, as a movable separation film, other organic materials such as polyimide previously known as a separation film, and that not only the durability of the head was improved but also it was possible to return to the normal state at once by performing a recovery treatment when detecting no discharge. Furthermore, corrosion caused by ink or the like was not found.

By the way, even in case of using the above separation film, since both the head substrate and the top board are configured by a material of silicon family, the heat radiation property of the head is excellent, and consequently, the effect of making the above head have a long life becomes more excellent.

Here, in the above manufacturing step, an additional description in regard to the vapor deposition of the PPX film will be given by referring to the following chemical formulae (G) to (I).

(G)

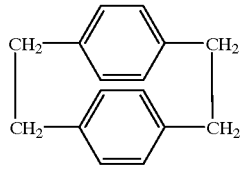

-continued (H)

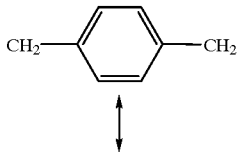

(I)

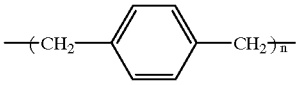

Each of formulae (G) to (I) is an explanation figure showing the change of the material in the reaction step of vapor deposition in case of preparing the separation film only by PPX (sample A) shown in formula (A). First, di-para-xylylene of a solid dimer to be a material shown in formula (G) is vaporized under the circumstance at a temperature of about 100° C. to 200° C. Next, the creation of a stable di-radical-para-xylylene monomer is performed under the above circumstance of a temperature of about 700° C. by heat decomposition of a dimer shown in formula (H). Then, the absorption and the polymerization of the di-radical-para-xylylene to members such as a head substrate to which the sacrificial layer is coated or an Si wafer are performed at the same time, and a movable film of poly-para-xylylene is formed at the room temperature.

Here, especially, by changing from the state of formula (H) to the state of formula (I), and by performing the movable film formation at a degree of vacuum of 0.1 [Torr] or less, the penetration into the details of the di-radical-para-xylylene which is a heat decomposition product of a dimer created in the vapor phase state is promoted, and by forming a chemically stable junction to the fixed portion of the movable film, the adhesion between the fixed portion (seat, liquid flow passage or the like) of the movable film and the movable film can be improved.

<Additional Technical Problem and Effect>

In the present invention, the substance made by considering the situation which can occur practically in the case where as mentioned above, the liquid discharge based on the bubble formation by film boiling is performed by using an organic film and by using a heating element exceeds the conventional technical level and is an effective invention.

By the way, the conventional technical level is such a level at which there are some substances having the problem recognition to improve the discharge efficiency but before them, there are a lot of simple substances which is separation films for simply separating the bubbling liquid and the discharge liquid.

From this view point, the above problem recognition of the present invention is "improvement of the durability to the separation film itself and the ink jet head considering the thermal factor in the displacement of the separation film accompanied with the series of changes of bubble generation—growth—debubbling] of the separation film of the present invention, and it is a novel one.

Accordingly, in the above respective descriptions which have solved this problem, the cause itself of the above problem is eliminated, and it is possible to return at once by the recovery processing even in case of an abnormal action. Accordingly, the term when each separation film can be used without being broken is considerably longer than that of the liquid discharge head having a conventional separation film, and the head itself is made to have a long life and in the meantime, there is an effect to prevent the partial damage of the head having a plurality of nozzles. Each invention is effective independently, and a more excellent effect can be attained by the combination.

What is claimed is:

1. A liquid discharge head comprising:

a plurality of first liquid flow passages which are connected to outlets for discharging discharge liquid;

a plurality of second liquid flow passages which have an element board with heating elements for generating a bubble in bubbling liquid and which correspond to said first liquid flow passages; and movable separation films which substantially and mutually separate said first liquid flow passages and said second liquid flow passages corresponding thereto at all times, wherein said movable separation films are mutually independent individual separation films for said respective second liquid flow passages.

2. The liquid discharge head according to claim 1, wherein said movable separation film is made so that an area opposite to said heating element may be convex toward said heating element.

3. The liquid discharge head according to claim 2, wherein said movable separation film is provided to a seat positioned in said second liquid flow passage, and an area from a fixing portion to said seat to an area opposite to said heating element is convex toward said first liquid flow passage.

4. The liquid discharge head according to claim 3, wherein said seat configures a side wall of said second liquid flow passage.

5. The liquid discharge head according to claim 1, comprising a top board member to which a flow passage wall configuring said first liquid flow passage is integrally provided, wherein said flow passage wall is joined without said movable separation film.

6. The liquid discharge head according to claim 1, wherein a flow passage wall configuring a side wall of said first liquid flow passage is integrally provided to said element board and a plate-like top board member is joined to an upper end of said flow passage wall.

7. The liquid discharge head according to claim 1, wherein said movable separation film is an organic film formed by an accumulation method using chemical vapor phase reaction or an accumulation method using plasma polymerization reaction.

8. The liquid discharge head according to claim 7, wherein said movable separation film contains poly-para-xylylene.

9. A liquid discharge head comprising:

a first liquid flow passage connected to an outlet for discharging discharge liquid;

a second liquid flow passage which has an element board with a heating element for generating a bubble in bubbling liquid and which corresponds to said first liquid flow passage; and a movable separation film which substantially and mutually separates said first liquid flow passage and said corresponding second liquid flow passage at all times, further comprising a seat to which said movable separation film is physically or chemically joined, wherein said movable separation film is not physically and chemically joined to an end portion on said heating element side of said seat.

10. The liquid discharge head according to claim 9, wherein said movable separation film is shaped so that an area opposite to said heating element may be convex toward said heating element.

11. The liquid discharge head according to claim 9, wherein said movable separation film is provided to said seat positioned in said second liquid flow passage, and an area from a fixing portion to said seat to an area opposite to said heating element is convex toward said first liquid flow passage.

12. The liquid discharge head according to claim 9, wherein said seat configures a side wall of said second liquid flow passage.

13. The liquid discharge head according to claim 9, comprising a top board member to which a flow passage wall configuring said first liquid flow passage is integrally provided, wherein said flow passage wall is joined without said movable separation film.

14. The liquid discharge head according to claim 9, wherein said movable separation film is an organic film formed by an accumulation method using chemical vapor phase reaction or an accumulation method using plasma polymerization reaction.

15. The liquid discharge head according to claim 14, wherein said movable separation film contains poly-para-xylylene.

16. A liquid discharge head comprising:

a plurality of first liquid flow passages connected to outlets for discharging discharge liquid;

a plurality of second liquid flow passages which have an element board with heating elements for generating a bubble in bubbling liquid and which correspond to said first liquid flow passages; and a movable separation organic film which substantially and mutually separates said first liquid flow passages and said second liquid flow passages corresponding thereto at all times, further comprising a seat to which said movable separation organic film is physically or chemically joined, wherein a tip portion of a flow passage wall provided for dividing said plurality of first liquid flow passages is pressed toward a joining area of said movable separation organic film joined to said seat, and the width W1 of said tip portion is smaller than the width W2 of said joining area.

17. The liquid discharge head according to claim 16, wherein said movable separation film is not physically and chemically joined to an end portion on said heating element side of said seat.

18. The liquid discharge head according to claim 16, wherein said movable separation film is provided to a seat positioned in said second liquid flow passage, and an area from a fixing portion to said seat to an area opposite to said heating element is convex toward said first liquid flow passage.

19. The liquid discharge head according to claim 16, wherein said movable separation film is an organic film formed by an accumulation method using chemical vapor phase reaction or an accumulation method using plasma polymerization reaction.

20. A liquid discharge head comprising:

a first liquid flow passage connected to an outlet for discharging discharge liquid;

a second liquid flow passage which has an element board with a heating element for generating a bubble in bubbling liquid and which corresponds to said first liquid flow passage; and a movable separation film which substantially and mutually separates said first liquid flow passage and said corresponding second liquid flow passage at all times, further comprising a seat to which said movable separation film is joined, wherein said movable separation film is adhered through an adhesive area patterned to said seat.

21. The liquid discharge head according to claim 20, wherein said adhesive area is provided only at a fixed portion to said element board of said movable separation film by said patterning.

22. The liquid discharge head according to claim 20, wherein said adhesive area is formed from a silane coupling agent.

23. The liquid discharge head according to claim 20, wherein said movable separation film is made such that an area opposite to said heating element is convex toward said heating element and a peripheral portion of the area opposite to said heating element is convex toward said first liquid flow passage, in a movable portion which is not fixed to said element board.

24. The liquid discharge head according to claim 20, wherein a flow passage wall configuring a side wall of said first liquid flow passage is integrally provided to said element board and a plate-like top board member is joined to an upper end of said flow passage wall.

25. The liquid discharge head according to claim 20, wherein said movable separation film is an organic film formed by an accumulation method using chemical vapor phase reaction or an accumulation method using plasma polymerization reaction.

26. The liquid discharge head according to claim 25, wherein said movable separation film contains poly-para-xylylene.

27. The liquid discharge head according to claim 20, wherein said movable member is an organic film and said seat comprises an inorganic member of a silicon family and said adhesive is a silane coupling agent.

28. A head cartridge comprising a liquid discharge head according to any one of claim 1 to claim 27 and an ink tank for keeping liquid discharged by the liquid discharge head.

29. A liquid discharge device comprising:

a liquid discharge head according to claim 1;

an ink tank for keeping liquid discharged by the liquid discharge head; and a mounting portion for mounting said liquid discharge head.

* * * * *